US011046914B2

(12) United States Patent
Kurth et al.

(10) Patent No.: US 11,046,914 B2
(45) Date of Patent: Jun. 29, 2021

(54) CLEANING AGENT COMPRISING A SURFACTANT-CONTAINING GEL PHASE

(71) Applicant: Henkel AG & Co. KGaA, Duesseldorf (DE)

(72) Inventors: Oliver Kurth, Langenfeld (DE); Robert Stephen Cappleman, Duisburg (DE); Michael Kreis, Leverkusen (DE); Boray Torun, Duesseldorf (DE); Filiz Yapici, Duesseldorf (DE); Thomas Weber, Weimar (DE); Thomas Doering, Dormagen (DE); Matthias Sunder, Duesseldorf (DE)

(73) Assignee: Henkel AG & Co. KGaA, Duesseldorf (DE)

( * ) Notice: Subject to any disclaimer, the term of this patent is extended or adjusted under 35 U.S.C. 154(b) by 0 days.

(21) Appl. No.: 16/513,684

(22) Filed: Jul. 16, 2019

(65) Prior Publication Data

US 2020/0024548 A1 Jan. 23, 2020

(30) Foreign Application Priority Data

Jul. 23, 2018 (DE) ..... 102018212207.5

(51) Int. Cl.

| | |
|---|---|
| ***C11D 1/66*** | (2006.01) |
| ***C11D 1/72*** | (2006.01) |
| ***C11D 3/37*** | (2006.01) |
| ***C11D 3/43*** | (2006.01) |
| ***C11D 3/20*** | (2006.01) |
| ***C11D 11/00*** | (2006.01) |
| ***C11D 17/00*** | (2006.01) |
| ***C11D 17/04*** | (2006.01) |

(52) U.S. Cl.

CPC ..... *C11D 1/721* (2013.01); *C11D 3/2079* (2013.01); *C11D 3/378* (2013.01); *C11D 3/3753* (2013.01); *C11D 3/43* (2013.01); *C11D 11/0023* (2013.01); *C11D 17/003* (2013.01); *C11D 17/043* (2013.01)

(58) Field of Classification Search

CPC .. C11D 1/66; C11D 1/72; C11D 1/721; C11D 3/3753; C11D 3/378; C11D 3/43; C11D 17/003; C11D 17/043; C11D 17/045

See application file for complete search history.

(56) References Cited

U.S. PATENT DOCUMENTS

| | | | | |
|---|---|---|---|---|
| 2003/0119695 | A1* | 6/2003 | Weuthen | C11D 1/721 510/295 |
| 2014/0135248 | A1* | 5/2014 | Graf | C11D 1/72 510/220 |
| 2017/0145356 | A1 | 5/2017 | Roy et al. | |
| 2017/0191004 | A1* | 7/2017 | Schmaelzle | C11D 3/0073 |
| 2017/0218314 | A1 | 8/2017 | Roy et al. | |
| 2018/0142191 | A1 | 5/2018 | Vockenroth et al. | |

OTHER PUBLICATIONS

European Patent Office, European Research Report, EP 19186483, dated Nov. 26, 2019, 8 pages.

* cited by examiner

*Primary Examiner* — Brian P Mruk
(74) *Attorney, Agent, or Firm* — Bojuan Deng

(57) ABSTRACT

A cleaning agent, preferably a dishwashing detergent, in particular an automatic dishwashing detergent, having at least one low-water, preferably substantially water-free, gel phase, which contains at least one particular non-ionic surfactant, preferably in quantities from 0.1 to 15 wt. %, from 0.5 to 10 wt. %, in particular from 0.8 to 8.5 wt. %, particularly preferably from 1 to 7 wt. %, for example from 1.0 to 4.0 wt. %, based on the total weight of the gel phase.

18 Claims, No Drawings

CLEANING AGENT COMPRISING A SURFACTANT-CONTAINING GEL PHASE

FIELD OF THE INVENTION

The invention relates to a cleaning agent, preferably a dishwashing detergent, in particular an automatic dishwashing detergent, comprising at least one low-water, preferably substantially water-free, gel phase, which contains at least one particular non-ionic surfactant, preferably in quantities of from 0.1 to 15 wt. %, of from 0.5 to 10 wt. %, in particular of from 0.8 to 8.5 wt. %, particularly preferably of from 1 to 7 wt. %, for example of from 1.0 to 4.0 wt. %, based on the total weight of the gel phase.

BACKGROUND OF THE INVENTION

Washing or cleaning agents are usually present in solid form (as tablets, for example) or in liquid form (or also as a flowing gel). Liquid washing or cleaning agents in particular are increasingly popular with consumers. Pre-portioned forms are popular with consumers because they are easier to meter. Pre-portioned flowing gels are often problematic because they tend to leak, for example when packed in single or multi-chamber bags.

BRIEF SUMMARY OF THE INVENTION

The problem addressed by the present invention is to provide cleaning agents, in particular dishwashing detergents, preferably automatic dishwashing detergents, which can be produced easily and cost-effectively and have good stability, even after long periods of storage.

The present invention firstly relates to a cleaning agent, preferably a dishwashing detergent, in particular an automatic dishwashing detergent, comprising at least one low-water, preferably substantially water-free, gel phase, which contains at least one non-ionic surfactant that has a melting point of greater than 30° C., preferably 34° C. or greater, preferably 36° C. or greater, in particular 40° C. or greater, in particular of from 40 to 60° C., particularly preferably of from 40 to 52° C., preferably in quantities of from 0.1 to 15 wt. %, of from 0.5 to 10 wt. %, in particular of from 0.8 to 8.5 wt. %, particularly preferably of from 1 to 7 wt. %, for example of from 1.0 to 4.0 wt. %, based on the total weight of the gel phase.

Since the surfactants according to the invention are frequently industrially prepared mixtures of surfactants, surfactants having different chain lengths and different degrees of alkoxylation may be present in a commercial product. This is expressed, for example, by number ranges such as $EO_{40-80}$. Due to the different chain lengths or the different degrees of alkoxylation, different molecular weights result. Because of this molecular weight distribution, commercially available surfactants may have a broader melting range.

The melting point of the surfactant (in ° C.) is determined by differential scanning calorimetry (DSC) according to ISO standard 11357. In this case, the peak temperature which can be determined using DSC in the second heating run is considered to be the melting point within the meaning of the invention. This is the temperature at which the vertex/maximum extent (on the y axis) is on the DSC graph. If several peaks are present in a surfactant (commercial product) within the limits of 5% of the maximum extent observed in the second heating run, the temperature of the first peak is considered to be the melting point according to the invention.

A particularly suitable surfactant is Dehypon GRA M (Dehypon 3697 GRA M, ex BASF) having a melting point specified by the manufacturer of between 48 and 53° C.

Other suitable surfactants are linear, saturated fatty acid alcohol ethoxylates having 14 to 18 C atoms in the alkyl chain and 10 to 100 ethylene oxide units, which are preferably not end-capped. Preferred here are those surfactants which are marketed under the trade name Lutensol (ex BASF), particularly preferably those which are marketed as Lutensol AT 18, 25, 50 or 80.

Other preferred non-ionic surfactants are ethoxylated monohydroxy alkanols or alkyl phenols that additionally have polyoxyethylene-polyoxypropylene block copolymer units. The alcohol or alkyl phenol fraction of such non-ionic surfactant molecules preferably constitutes greater than 30 wt. %, particularly preferably greater than 50 wt. %, and in particular greater than 70 wt. % of the total molar mass of such non-ionic surfactants. Preferred agents are characterized in that they contain ethoxylated and propoxylated non-ionic surfactants in which the propylene oxide units in the molecule constitute up to 25 wt. %, preferably up to 20 wt. %, and particularly up to 15 wt. % of the total molar mass of the non-ionic surfactant.

Suitable surfactants are, for example, block copolymers from BASF, which in particular are marketed under the name Pluronic® PE F68, 87, 88 or 127.

The invention also relates to a cleaning agent, preferably a dishwashing detergent, in particular an automatic dishwashing detergent, comprising at least one low-water, preferably substantially water-free, gel phase, which contains at least one non-ionic surfactant of formula (I)

$$R^1O[CH_2CH(CH_3)O]_x[CH_2CH_2O]_y[CH_2CH(CH_3)O]_z CH_2CH(OH)R^2$$

in which $R^1$ represents a linear or branched aliphatic hydrocarbon functional group having 4 to 22 carbon atoms, $R^2$ represents a linear or branched hydrocarbon functional group having 2 to 26 carbon atoms, x and z represents values of from 0 to 40, and y represents a value of at least 15, preferably in quantities of from 0.1 to 15 wt. %, of from 0.5 to 10 wt. %, in particular of from 0.8 to 8.5 wt. %, particularly preferably of from 1 to 7.0 wt. %, for example of from 1.0 to 4.0 wt. %, based on the total weight of the gel phase.

According to a preferred embodiment, the invention relates to a cleaning agent, preferably a dishwashing detergent, in particular an automatic dishwashing detergent, comprising at least one low-water, preferably substantially water-free, gel phase, which contains at least one non-ionic surfactant of formula (II)

$$R^1O[CH_2CH_2O]_yCH_2CH(OH)R^2$$

in which $R^1$ represents a linear or branched aliphatic hydrocarbon functional group having 4 to 22 carbon atoms, $R^2$ represents a linear or branched hydrocarbon functional group having 2 to 26 carbon atoms, and y represents a value of from 15 to 120, preferably 20 to 100, and in particular 40 to 80.

Preferred classes of surfactants of this kind have, as R1 or R2, independently of one another, 6 to 20, preferably 8 to 14 C atoms, in the alkyl chain, and comprise 40 to 150, preferably 40 to 80 alkoxyl units, preferably ethylene oxide (EO) and/or propylene oxide (PO) units, in particular ethylene oxide units. Particularly preferred are those surfactants of formula (II), in which $R^1$ represents a linear or branched aliphatic hydrocarbon functional group having 8 to 14 carbon atoms, $R^2$ represents a linear or branched hydrocarbon functional group having 8 to 20 carbon atoms, and which have 40 to 80 ethylene oxide units.

One advantage of the invention is that gel phases according to the invention solidified more rapidly at room temperature (20° C.) after pouring than similar gel phases without the non-ionic surfactants according to the invention. In particular, it has been found that the presence of surfactants according to the invention, such as Dehypon GRA M, has a positive influence on the sol-gel transition temperature. The sol-gel transition temperature means the temperature threshold at which a viscous flowing phase changes into a viscoelastic (gel) phase. The gels therefore needed less time for the formation of the gel phase and thus were already solid at higher temperatures or in a shorter time. This means that gel phases of this kind can be processed faster. Therefore, a surprising effect of the present invention is that gel phases according to the invention can be processed more rapidly compared with gel phases without the surfactants according to the invention, thus resulting in more cost-efficient production.

Surprisingly, after being poured into a corresponding cavity, the gel phases also demonstrated a markedly lower egress of visible moisture (syneresis) than those gel formulations which did not contain a surfactant according to the invention.

In a preferred embodiment, the at least one surfactant according to the invention is contained in the gel phase in quantities of from 0.1 to 15 wt. %, of from 0.5 to 10 wt. %, in particular of from 0.8 to 8.5 wt. %, particularly preferably of from 1 to 7.0 wt. %, for example of from 1.0 to 4.0 wt. %, based on the total weight of the gel phase in each case.

A gel-like phase, hereinafter also referred to as gel phase, is to be understood according to the invention as meaning a composition/phase which has an internally structuring network. This internally structuring (spatial) network is formed by the dispersion of a solid but distributed substance with long or highly branched particles and/or gelling agents, in at least one liquid (the at least one liquid is liquid at 20° C.). Gel phases of this kind are thermoreversible.

This gel phase can be, for example, flowable or dimensionally stable. According to the invention, however, the gel phase is preferably dimensionally stable at room temperature. During preparation, as a gelling agent, polyvinyl alcohol and/or the derivatives thereof are brought into contact with a solvent, preferably an organic solvent, preferably one or more polyhydric alcohol(s). This enables a flowable mixture to be obtained that can be molded into shape as desired. After a certain period of time, a gel phase is obtained which remains in the given form, i.e. is dimensionally stable. This time period, the setting time, is preferably 15 minutes or less, more preferably 10 minutes or less, particularly preferably 5 minutes or less. In this case, the at least one gel phase gives way to pressure, but does not deform, and instead returns to its initial state after the pressure has ceased. The at least one gel phase is preferably elastic, in particular linear-elastic.

The at least one gel phase is preferably a molded body. A molded body is a single body that stabilizes itself in the shape imparted to it. This dimensionally stable body is formed from a molding compound (e.g. a composition) in such a way that this molding compound is deliberately brought into a predetermined shape, for example by pouring a liquid composition into a casting mold and then curing the liquid composition, for example as part of a sol-gel process.

Certain minimum requirements apply to formulations of the at least one gel phase. As already mentioned, the gel phase must solidify within as short a time as possible. Long setting times would result in long production time and thus lead to high costs. According to the invention, solidification time means the period of time during which the at least one gel phase changes from a flowable state to a dimensionally stable state which is non-flowable at room temperature during preparation. Room temperature is to be understood as a temperature of 20° C.

The at least one gel phase is preferably a solid gel phase. It is therefore sliceable. For example, it can be cut with a knife after it sets without being destroyed beyond the cut that is made.

At least one gel phase is low-water. Within the meaning of the present invention, low-water means that small quantities of water can be used to prepare the at least one gel phase. The proportion of water in the gel phase is in particular 20 wt. % or less, preferably 15 wt. % or less, particularly 12 wt. % or less, in particular from 10 to 5 wt. %. The quantities in wt. % refer to the total weight of the gel phase. This has the advantage that the small amounts of water in combination with PVOH can have a structure-forming or gel-forming effect.

According to a preferred embodiment, the at least one gel phase is substantially water-free. This means that the gel phase is preferably substantially free of water. "Substantially free" means in this case that the gel phase may contain small quantities of water. For example, this water can be introduced into the phase by means of a solvent or as water of crystallization or as a result of reactions of components of the phase with each other. However, only small quantities of water, and in particular no water, are preferably used as a solvent for preparing the gel phase. The proportion of water in the gel phase in this embodiment is 4.9 wt. % or less, 4 wt. % or less, preferably 2 wt. % or less, in particular 1 wt. % or less, particularly 0.5 wt. % or less, in particular 0.1 wt. % or 0.05 wt. % or less. The quantities in wt. % refer to the total weight of the gel phase in this case.

DETAILED DESCRIPTION OF THE INVENTION

These and other aspects, features, and advantages of the invention will become apparent to a person skilled in the art through the study of the following detailed description and claims. Any feature from one aspect of the invention can be used in any other aspect of the invention. Furthermore, it will readily be understood that the examples contained herein are intended to describe and illustrate but not to limit the invention and that, in particular, the invention is not limited to these examples. Unless indicated otherwise, all percentages are indicated in terms of wt. %. Numerical ranges that are indicated in the format "from x to y" also include the stated values. If several preferred numerical ranges are indicated in this format, it is self-evident that all ranges that result from the combination of the various endpoints are also included.

"At least one," as used herein, means one or more, i.e. one, two, three, four, five, six, seven, eight, nine, or more. In relation to an ingredient, the expression refers to the type of ingredient and not to the absolute number of molecules. "At least one bleach catalyst" therefore means at least one type of bleach catalyst, for example—that is, that one type of bleach catalyst or a mixture of several different bleach catalysts can be used. Together with weight specifications, the expression relates to all compounds of the type indicated that are contained in the composition/mixture, that is to say that the composition does not contain any other compounds of this type beyond the indicated quantity of the corresponding compounds.

When reference is made herein to molar masses, this information always refers to the number-average molar mass $M_n$, unless explicitly indicated otherwise. The number-average molecular mass can, for example, be determined by gel permeation chromatography (GPC) according to DIN 55672-1:2007-08 with THF as the eluent. The number-average molar mass $M_w$ can also be determined by means of GPC, as described for $M_n$.

Unless explicitly indicated otherwise, all percentages that are cited in connection with the compositions described herein relate to wt. %, in each case with respect to the relevant mixture or phase.

Furthermore, the gel phase must be storage stable under normal storage conditions. The gel phase according to the invention is a component of a cleaning agent. Cleaning agents are usually stored for a certain period of time in a household. They are usually stored near the washing machine or dishwasher. For such storage, the gel phase should be stable. Therefore, the gel phase should be stable, especially after a storage period of 4 to 12 weeks, especially 10 to 12 weeks or longer at a temperature of up to 40° C., particularly at 30° C., in particular at 25° C. or at 20° C., and should not deform or otherwise change in consistency during this time.

If the gel phase and a solid phase, in particular a powder phase, are present in direct contact with each other, the gel phase preferably penetrates a maximum of 1 mm into the interstices of the immediately underlying powder phase during the storage period of 4 weeks at 25° C.

A change in volume or shrinkage during storage would be disadvantageous, since that would diminish consumers' acceptance of the product. A leakage of liquid or components sweating out of the gel phase is also undesirable. Here, too, the visual impression is relevant, for one thing. The stability of the gel phase can be influenced by the leakage of liquid, such as solvents, such that the components are no longer stably contained and the washing or cleaning effect can also be influenced as a result.

According to another preferred embodiment of the present invention, cleaning agents, preferably dishwashing detergents, in particular automatic dishwashing detergents, which are packaged as detergent portions, preferably containing the active substances necessary for a cleaning cycle, preferably contain 0.05 to 2 g, preferably 0.1 to 1.0 g, in particular 0.3 to 0.9 g as the total quantity of all non-ionic surfactants in the cleaning agent portion.

This means that the individual cleaning agent portion which is used to carry out an individual cleaning cycle, in particular is added to a cleaning cycle of a dishwasher, contains 0.05 to 2 g, preferably 0.1 to 1.0 g, in particular 0.3 to 0.9 g, surfactants.

Particularly preferably, a single cleaning agent portion according to the invention, which in particular is added to a cleaning cycle of a dishwasher, contains 1.5 wt. % to 8 wt. %, preferably 2.0 wt. % to 7.0 wt. %, surfactants, based on the total quantity of the cleaning agent.

According to a preferred embodiment, the cleaning agents according to the invention, preferably dishwashing detergents, in particular automatic dishwashing detergents, contain in the gel phase, as a gelling agent, polyvinyl alcohol and/or the derivatives thereof, particularly preferably polyvinyl alcohol, in a quantity of from 4 to 40 wt. %, in particular of from 6 to 30 wt. %, particularly preferably in a quantity of from 7 to 24 wt. %, more particularly preferably 8 to 22 wt. %, in particular for example 14 to 20 wt. %, based on the total weight of the gel phase in each case.

According to the invention, the at least one gel phase particularly preferably comprises PVOH (polyvinyl alcohol) and/or the derivatives thereof. Polyvinyl alcohols are thermoplastic materials that are manufactured as white to yellowish powders, usually by hydrolysis of polyvinyl acetate. Polyvinyl alcohol (PVOH) is resistant to almost all water-free organic solvents. Polyvinyl alcohols having a molar mass of from 30,000 to 60,000 g/mol are preferred.

Within the meaning of the invention, derivatives of PVOH are preferably copolymers of polyvinyl alcohol with other monomers, in particular copolymers with anionic monomers. Suitable anionic monomers are preferably vinyl acetic acid, alkyl acrylates, maleic acid and derivatives thereof, in particular monoalkyl maleates (in particular monomethyl maleate), dialkyl maleates (in particular dimethyl maleate), maleic anhydride, fumaric acid and derivatives thereof, in particular monoalkyl fumarate (in particular monomethyl fumarate), dialkyl fumarate (in particular dimethyl fumarate), fumaric anhydride, itaconic acid and derivatives thereof, in particular monomethyl itaconate, dialkyl itaconate, dimethyl itaconate, itaconic anhydride, citraconic acid (methylmaleic acid) and derivatives thereof, monoalkyl citraconic acid (in particular methyl citraconate), dialkyl citraconic acid (dimethyl citraconate), citraconic anhydride, mesaconic acid (methyl fumaric acid) and derivatives thereof, monoallyl mesaconate, dialkyl mesaconate, mesaconic anhydride, glutaconic acid and derivatives thereof, monoalkyl glutaconate, dialkyl glutaconate, glutaconic anhydride, vinylsulfonic acid, alkyl sulfonic acid, ethylene sulfonic acid, 2-acrylamido-1-methylpropanesulfonic acid, 2-acrylamido-2-methylpropanesulfonic acid, 2-methylacrylamido-2-methylpropanesulfonic acid, 2-sulfoethyl acrylate and combinations thereof, and the alkali metal salts or esters of the above-mentioned monomers.

Particular preferred derivatives of PVOH are those selected from copolymers of polyvinyl alcohol with a monomer, in particular selected from the group of monoalkyl maleates (in particular monomethyl maleate), dialkyl maleates (in particular dimethyl maleate), maleic anhydride, and combinations thereof, and the alkali salts or esters of the above-mentioned monomers. The values stated for polyvinyl alcohols themselves apply to the suitable molecular masses. In the context of the present invention, it is preferred for the at least one gel phase to comprise a polyvinyl alcohol and/or derivatives thereof, preferably polyvinyl alcohol, of which the degree of hydrolysis is preferably 70 to 100 mol. %, in particular 80 to 90 mol. %, particularly preferably 81 to 89 mol. %, and even more preferably 82 to 88 mol. %.

Particularly preferred polyvinyl alcohols are those present as white-yellowish powders or granular material having degrees of polymerization in the range of from approximately 100 to 2,500 (molar masses of from approximately 4,000 to 100,000 g/mol) and degrees of hydrolysis of from 80 to 99 mol. %, preferably from 85 to 90 mol. %, in particular from 87 to 89 mol. %, for example 88 mol. %, which accordingly also contain a residual content of acetyl groups.

PVOH powders which have the above-mentioned properties and are suitable for use in the at least one gel phase are marketed by Kuraray, for example, under the name Mowiol® or Poval®. Exceval® AQ4104 from Kuraray is also suitable, for example. Particularly suitable are Mowiol C30, the Poval® grades, in particular grades 3-83, 3-88, 6-88, 4-85, and particularly preferably 4-88, very particularly preferably Poval 4-88 S2, and Mowiol® 4-88 from Kuraray.

The water solubility of polyvinyl alcohol can be altered by post-treatment with aldehydes (acetalization) or ketones (ketalization). Particularly preferred and, due to their decidedly good solubility in cold water, particularly advantageous polyvinyl alcohols have been produced which can be acetalized or ketalized with the aldehyde or keto groups of saccharides or polysaccharides or mixtures thereof. It is extremely advantageous to use the reaction products of polyvinyl alcohol and starch. Furthermore, the water solubility can be altered and thus set at desired values in a targeted manner by complexing with Ni or Cu salts or by treatment with dichromates, boric acid, or borax.

Surprisingly, PVOH has been demonstrated to be particularly suitable for preparing gel phases that meet the requirements set out above. At least one gel phase that comprises PVOH as well as at least one polyhydric alcohol in addition to the surfactant according to the invention is therefore particularly preferred. Particularly preferably, the at least one gel phase comprises PVOH and at least one polyhydric alcohol.

According to the invention, the at least one gel phase comprises the surfactant according to the invention preferably in a quantity of from 0.5 to 10 wt. %, in particular of from 0.8 to 8.5 wt. %, particularly preferably of from 1 to 7 wt. %, for example of from 1.0 to 4.0 wt. %, based on the total weight of the gel phase, and comprises PVOH and/or derivatives thereof in a proportion of approximately 4 wt. % to 40 wt. %, in particular of from 6 wt. % to 30 wt. %, preferably of from 7 to 24 wt. %, in particular of from 8 wt. % to 22 wt. %. Significantly lower proportions of PVOH do not lead to the formation of a stable gel phase. The values are based in each case on the total weight of the gel phase.

According to a particularly preferred embodiment, the at least one gel phase comprises PVOH (polyvinyl alcohol). These gel phases prepared in this way are particularly high-melting, dimensionally stable (even at 40° C.) and do not change in shape during storage or change only insignificantly. In particular, they are also less reactive with respect to a direct negative interaction with components of the granular mixture, in particular the powder phase. PVOH can in particular also produce low-water or water-free gel phases without difficulty. Using PVOH as the polymer for the at least one gel phase results in low-viscosity melts at 110-120° C. which can therefore be processed particularly easily, in particular the filling of the gel phase into the water-soluble wrapping can be carried out quickly and accurately without any adhesion or the quantity being inaccurately metered. Furthermore, said gel phases adhere particularly well to the water-soluble wrapping, in particular if it is also made of PVOH. This is also visually advantageous. Due to the rapid solidification of the at least one gel phase comprising PVOH, the further processing of the gel phases can take place particularly quickly. Furthermore, the good solubility of the produced gel phases is particularly favorable for the overall solubility of the cleaning agent. In addition, gel phases having such short solidification times are advantageous in that the at least one solid phase, which is metered thereon and comprises granular mixtures, in particular powder, does not sink into the gel which is not yet completely set or is still too soft. This leads to cleaning agent portions that are less visually attractive.

In the multiphase single-use portions according to the invention that comprise at least one solid phase, it is particularly important that the at least one second phase is dimensionally stable, so that as few interactions as possible can take place between the solid phase and the gel phase. If the at least one gel phase comprises gelatin in addition to PVOH, the tenacity of the gel phase during preparation is increased.

Another preferred subject of the present invention is cleaning agents, preferably dishwashing detergents, in particular automatic dishwashing detergents, which contain at least one organic solvent, in particular selected from 1,2-propanediol, 1,3-propanediol, glycerol, 1,1,1-trimethylolpropane, triethylene glycol, dipropylene glycol, polyethylene glycols and/or mixtures thereof, in the gel phase.

The at least one gel phase preferably comprises at least one polyhydric alcohol. In addition to the preparation of flowable gel phases, the at least one polyhydric alcohol enables the preparation of a dimensionally stable, non-flowable gel phase within a short setting time that is within 15 minutes or less, in particular 10 minutes or less. Polyhydric alcohols within the meaning of the present invention are hydrocarbons in which two, three, or more hydrogen atoms are replaced by OH groups. The OH groups are each bonded to different carbon atoms. No carbon atom has two OH groups. This is in contrast with (simple) alcohols, in which only one hydrogen atom is replaced by an OH group in hydrocarbons. Polyhydric alcohols having two OH groups are referred to as alkanediols, and polyhydric alcohols having three OH groups are referred to as alkanetriols. A polyhydric alcohol thus corresponds to general formula $[KW](OH)_X$, where KW represents a hydrocarbon that is linear or branched, saturated or unsaturated, substituted or unsubstituted. A substitution can occur with —SH or —NH groups, for example. Preferably, KW is a linear or branched, saturated or unsaturated, unsubstituted hydrocarbon. KW comprises at least two carbon atoms. The polyhydric alcohol comprises 2, 3, or more OH groups (x=2, 3, 4 . . . ), with only one OH group being bonded to each C atom of the KW. Particularly preferably, KW comprises 2 to 10, i.e. 2, 3, 4, 5, 6, 7, 8, 9, or 10, carbon atoms. Polyhydric alcohols in which x=2, 3, or 4 can be used in particular (for example, pentaerythritol where x=4). Preferably, x=2 (alkanediol) and/or x=3 (alkanetriol).

Particularly preferably, the at least one gel phase comprises at least one alkanetriol and/or at least one alkanediol, in particular at least one $C_3$ to $C_{10}$ alkanetriol and/or at least one $C_3$ to $C_{10}$ alkanediol, preferably at least one $C_3$ to $C_8$ alkanetriol and/or at least one $C_3$ to $C_8$ alkanediol, particularly at least one $C_3$ to $C_6$ alkanetriol and/or at least one $C_3$ to $C_5$ alkanediol, as a polyhydric alcohol. Preferably, it comprises one alkanetriol and one alkanediol as at least one polyhydric alcohol. In a preferred embodiment, the at least one gel phase thus comprises at least one polymer, in particular PVOH or PVOH with gelatin, as well as at least one alkanediol and at least one alkanetriol, in particular one alkanetriol and one alkanediol. A gel phase comprising at least one polymer, PVOH or PVOH with gelatin, and a $C_3$ to $C_8$ alkanediol and a $C_3$ to $C_8$ alkanetriol is equally preferred. A gel phase comprising at least one polymer, in particular PVOH or PVOH with gelatin, and a $C_3$ to $C_5$ alkanediol and a $C_3$ to $C_6$ alkanetriol is more preferred. According to the invention, the polyhydric alcohols do not comprise any derivatives thereof, such as ethers, esters, etc.

Surprisingly, it has been demonstrated that, when a corresponding triol (alkanetriol) is combined with a corresponding diol (alkanediol), particularly short setting times can be achieved. The terms "diol" and "alkanediol" are used synonymously herein. The same applies to "triol" and "alkanetriol."

According to a particularly preferred embodiment, the cleaning agents according to the invention, preferably dishwashing detergents, in particular automatic dishwashing detergents, contain the at least one organic solvent in the gel phase in quantities of from 30 to 90 wt. %, in particular from 40 to 85 wt. %, more preferably from 50 to 80 wt. %, based on the total weight of the gel phase.

The quantity of polyhydric alcohol or polyhydric alcohols used in gel phases according to the invention is preferably at least 45 wt. %, in particular 55 wt. % or more. Preferred quantity ranges are from 45 wt. % to 85 wt. %, in particular from 50 wt. % to 80 wt. %, based on the total weight of the gel phase.

Preferably, the $C_3$ to $C_6$ alkanetriol is glycerol and/or 2-ethyl-2-(hydroxymethyl)-1,3-propanediol (also called 1,1,1-trimethylolpropane) and/or 2-amino-2-(hydroxymethyl)-1,3-propanediol (TRIS, tris hydroxymethyl aminoethane) and/or 1,3,5-pentanetriol.

The $C_3$ to $C_6$ alkanetriol is particularly preferably glycerol and/or 2-ethyl-2-(hydroxymethyl)-1,3-propanediol (also called 1,1,1-trimethylolpropane). The $C_3$ to $C_5$ alkanediol is, for example, 1,5-pentanediol, 3-methyl-1,5-pentanediol, 1,4-butanediol, 1,3-propanediol and/or 1,2-propanediol, preferably 1,3-propanediol and/or 1,2-propanediol. The OH groups of the diol are therefore preferably not arranged on immediately adjacent C atoms. In particular, three or four carbon atoms, in particular three carbon atoms, are located between the two OH groups of the diol. Particularly preferably, the diol is 1,3-propanediol. Surprisingly, it has been found that particularly good results are obtained with mixtures that comprise glycerol and 1,3-propanediol and/or 1,2-propanediol.

According to the invention, polyethylene glycol(s) having an average molar mass of from 200 to 600 g/mol are preferably also used in the at least one gel phase or the gel phases. In combination with polyvinyl alcohol, polyethylene glycols with an average molar mass of between about 200 and about 600 g/mol, preferably between 300 and 500 g/mol, in particular between 350 and 450 g/mol, for example around 400 g/mol (INCI: PEG400), are used. Cleaning agent portions according to the invention are therefore characterized in that they comprise polyethylene glycol(s) having an average molar mass of from 300 to 500 g/mol, in particular from 350 to 450 g/mol.

In particular, it is advantageous for the at least one gel phase or gel phases, comprising, in each case based on the total weight of the gel phase, in addition to at least one surfactant according to the invention, preferably in a quantity of from 0.5 to 10 wt. %, in particular from 0.8 to 8.5 wt. %, particularly preferably 1 to 7 wt. %, for example from 1.0 to 4.0 wt. %, based on the total weight of the gel phase, to contain polyvinyl alcohol and at least one polyhydric alcohol, and optionally additionally polyethylene glycols having an average molar mass of about 200 to 600 g/mol in quantities of from 5 to 30 wt. %, preferably from 8 to 26 wt. %, in particular from 10 to 22 wt. % based on the total weight of the at least one gel phase.

Surprisingly, it has been found that the addition of polyethylene glycols, in particular those having average molar masses of from 200 to 600 g/mol, to the at least one gel phase, in particular in gel phases comprising polyvinyl alcohol, leads to an acceleration of the solidification time of the gel phases. Values of a few minutes and even less than a minute can be achieved. This is highly advantageous, in particular for the production sequences, since the further processing of the gel phases in the solidified state can take place much more quickly and therefore usually more cost-effectively. Surprisingly, it has been found that the presence of polyethylene glycol(s) having an average molar mass of from 200 to 600 g/mol in combination with polyvinyl alcohol and/or derivatives thereof contributes significantly to reducing the setting times. Without being bound to the theory, it is assumed that such polyethylene glycols, in particular those having a molar mass of from 350 to 450 g/mol, in particular approximately 400 g/mol, increase the sol-gel temperature.

In a particularly preferred embodiment, the quantity of polyethylene glycol(s) having an average molar mass of from 350 to 450 g/mol, for example approximately 400 g/mol, is 10 to 22 wt. % based on the total weight of the gel phase.

A particularly preferred gel phase therefore comprises at least one non-ionic surfactant, PVOH, polyethylene glycol(s) having an average molar mass of from 200 to 600 g/mol and 1,3-propanediol and glycerol or 1,1,1-trimethylolpropane as polyhydric alcohols. Here, a non-flowable consistency that is dimensionally stable at room temperature can be achieved within a setting time of 10 minutes or less that remains dimensionally stable even after an extended storage period. A particularly preferred gel phase therefore comprises PVOH and/or derivatives thereof, preferably PVOH as a polymer, and PEG having a molar mass of from 200 to 600 g/mol, 1,3-propanediol and glycerol or 1,1,1-trimethylolpropane as polyhydric alcohols.

If, in addition to at least one non-ionic surfactant according to the invention, preferably in a quantity of from 0.5 to 10 wt. %, in particular from 0.8 to 8.5 wt. %, particularly preferably 1.0 to 7.0 wt. %, for example from 1.0 to 4.0 wt. %, based on the total weight of the gel phase, the gel phase comprises, based on the total weight of the gel phase in each case, an alkanetriol, in particular glycerol or 1,1,1-trimethylolpropane, based in each case on the total weight of the gel phase, then the proportion of alkanetriol, in particular glycerol or 1,1,1-trimethylolpropane, based in each case on the total weight of the gel phase, is between 3 and 75 wt. % of the gel phase, preferably 5 wt. % to 70 wt. %, in particular 10 wt. % to 65 wt. %, particularly 20 wt. % to 40 wt. %.

If the gel phase optionally comprises a plurality of alkanetriol(s), then the total proportion of alkanetriol(s) is between 3 and 75 wt. %, preferably 5 wt. % to 70 wt. %, in particular 10 wt. % to 65 wt. %, particularly 20 wt. % to 40 wt. %, based on the total weight of the gel phase.

If glycerol is contained as an alkanetriol in the gel phase, then the proportion of glycerol based on the total weight of the gel phase is preferably 5 wt. % to 70 wt. %, particularly 10 wt. % to 65 wt. %, particularly 20 wt. % to 40 wt. %.

If 1,1,1-trimethylolpropane is contained in the gel phase, then the proportion of 1,1,1-trimethylolpropane based on the total weight of the gel phase is preferably 5 wt. % to 70 wt. %, in particular 10 wt. % to 65 wt. %, particularly preferably 18 to 45 wt. %, in particular 20 wt. % to 40 wt. %.

If 2-amino-2-hydroxymethyl-1,3-propanediol is present in the gel phase, the proportion of 2-amino-2-hydroxymethyl-1,3-propanediol, based on the total weight of the gel phase, is preferably 5 wt. % to 70 wt. %, in particular 10 wt. % to 65 wt. %, particularly 20 wt. % to 40 wt. %.

If several alkanediols are optionally present in the gel phase, the proportion of alkanediols, based on the total weight of the gel phase, is preferably 5 wt. % to 70 wt. %, in particular 7 wt. % to 65 wt. %, particularly 10 wt. % to 40 wt. %.

If, in addition to at least one non-ionic surfactant according to the invention, preferably in a quantity of from 0.5 to 10 wt. %, in particular from 0.8 to 8.5 wt. %, particularly preferably 1 to 7 wt. %, for example from 1.0 to 4.0 wt. %, based on the total weight of the gel phase in each case, the gel phase comprises at least one alkanediol, in particular 1,3-propanediol or 1,2-propanediol, based on the total weight of the gel phase, the proportion of alkanediol, in particular 1,3-propanediol or 1,2-propanediol, based on the total weight of the gel phase, is preferably 5 wt. % to 70 wt. %, in particular 10 wt. % to 65 wt. %, particularly 20 wt. % to 45 wt. %. If 1,3-propanediol is present in the gel phase, the proportion of 1,3-propanediol, based on the total weight of the gel phase, is in particular 10 wt. % to 65 wt. %, in particular 20 wt. % to 45 wt. %.

A gel phase is preferred which, in each case based on the total weight of the gel phase, contains, in addition to at least one non-ionic surfactant according to the invention, preferably in a quantity of from 0.5 to 10 wt. %, in particular from 0.8 to 8.5 wt. %, particularly preferably 1 to 7 wt. %, for example from 1.0 to 4.0 wt. %, based on the total weight of the gel phase, 20 to 45 wt. % of 1,3 propanediol and/or 1,2-propanediol and 10 wt. % to 65 wt. % of 2-amino-2-hydroxymethyl-1,3-propanediol, in each case based on the total weight of the gel phase. A gel phase containing 20 to 45 wt. % of 1,3 propanediol and/or 1,2 propanediol and 10 to 65 wt. % of 1,1,1 trimethylolpropane, in each case based on the total weight of the gel phase, is likewise preferred. In particular, a gel phase containing 20 to 45 wt. % of 1,3 propanediol and/or 1,2 propanediol and 10 to 65 wt. % of glycerol, in each case based on the total weight of the gel phase, is preferred. It has been found that, in these ranges, quick setting of a gel phase is possible at 20° C. and yields phases that are stable in storage. In particular, the glycerol proportion has an impact on the curing time.

If the at least one gel phase according to the invention, based in each case on the total weight of the gel phase, has, in addition to at least one non-ionic surfactant according to the invention, preferably in a quantity of from 0.5 to 10 wt. %, in particular from 0.8 to 8.5 wt. %, particularly preferably 1 to 7 wt. %, for example from 1.0 to 4.0 wt. %, based on the total weight of the gel phase, a $C_3$ to $C_6$ alkanetriol and a $C_3$ to $C_5$ alkanediol, their weight ratio is preferably from 3:1 to 1:2. In particular, the weight ratio is from 2:1 to 1:1.5, preferably from 1.5:1 to 1:1.2, preferably from 1.3 to 1:1, when glycerol and 1,3-propanediol are contained as polyhydric alcohols. Surprisingly, it has been found that, with these weight ratios, storage-stable, shiny gel phases can be obtained within short setting times of 10 minutes or less at 20° C. In combination with polyethylene glycols having an average molar mass of from 200 to 600 g/mol, the preferred above-mentioned weight ratios, in particular weight ratios ($C_3$ to $C_6$ alkanetriol: $C_3$ to $C_5$ alkanediol) of from 1.5:1 to 1:1.2, allow a reduction to setting times of 5 minutes or less.

According to another preferred embodiment, in addition to the above-mentioned alkanols, triethylene glycol may be present in the at least one gel phase, in particular the gel phases described above as being preferred, especially if this phase contains PVOH and optionally polyethylene glycols having an average molar mass of from 200 to 600 g/mol. Triethylene glycol advantageously accelerates the solidification of the gel phase(s). It also causes the resulting gel phase to exchange little, if any, liquid with the environment, in a manner that is not perceptible. This improves in particular the visual impression of the resulting cleaning agent portions. It is particularly preferred if the at least one gel phase, in each case based on the total weight of the gel phase, contains, in addition to at least one non-ionic surfactant according to the invention, preferably in a quantity of from 0.5 to 10 wt. %, in particular from 0.8 to 8.5 wt. %, particularly preferably 1 to 7 wt. %, for example from 1.0 to 4.0 wt. %, based on the total weight of the gel phase, 1,3 and/or 1,2-propanediol, more preferably 1 to 3.5 wt. % of 1,3-propanediol, and glycerol between 0.1 and 20 wt. %, preferably between 1 and 15 wt. %, in particular between 5 and 12 wt. %, for example 8 to 11 wt. % triethylene glycol.

Furthermore, the at least one gel phase preferably comprises another anionic polymer, in particular polycarboxylates. These can act either as builders and/or as thickening polymers. According to the invention, the at least one gel phase can further comprise anionic polymers or copolymers having builder properties. This is preferably a polycarboxylate. A copolymeric polyacrylate, preferably a sulfopolymer, preferably a copolymeric polysulfonate, preferably a hydrophobically modified copolymeric polysulfonate, is preferably used as the polycarboxylate. The copolymers can have two, three, four, or more different monomer units. Preferred copolymeric polysulfonates contain, besides sulfonic acid group-containing monomer(s), at least one monomer from the group of unsaturated carboxylic acids.

According to a particularly preferred embodiment, the low-water gel phase contains a polymer comprising at least one sulfonic acid group-containing monomer.

As the unsaturated carboxylic acid(s), unsaturated carboxylic acids of formula $R^1(R^2)C{=}C(R^3)COOH$ are particularly preferably used, in which $R^1$ to $R^3$, independently of one another, represent —H, —$CH_3$, a straight-chain or branched saturated alkyl functional group having 2 to 12 carbon atoms, a straight-chain or branched, mono- or polyunsaturated alkenyl functional group having 2 to 12 carbon atoms, with —NH2, —OH, or —COOH substituted alkyl or alkenyl functional groups as defined above, or represent —COOH or —$COOR^4$, where $R^4$ is a saturated or unsaturated, straight-chain or branched hydrocarbon functional group having 1 to 12 carbon atoms.

Particularly preferred unsaturated carboxylic acids are acrylic acid, methacrylic acid, ethacrylic acid, α-chloroacrylic acid, α-cyanoacrylic acid, crotonic acid, α-phenylacrylic acid, maleic acid, maleic anhydride, fumaric acid, itaconic acid, citraconic acid, methylene malonic acid, sorbic acid, cinnamic acid, or mixtures thereof. Unsaturated dicarboxylic acids can obviously also be used.

For sulfonic acid group-containing monomers, those of formula $R^5(R^6)C{=}C(R^7)$—X—$SO_3H$ are preferred, in which $R^5$ to $R^7$, independently of one another, represent —H, —$CH_3$, a straight-chain or branched saturated alkyl functional group having 2 to 12 carbon atoms, a straight-chain or branched, mono- or polyunsaturated alkenyl functional group having 2 to 12 carbon atoms, with —$NH_2$, —OH, or —COOH substituted alkyl or alkenyl functional groups, or represent —COOH or —$COOR^4$, where $R^4$ is a saturated or unsaturated, straight-chain or branched hydrocarbon functional group having 1 to 12 carbon atoms, and X represents an optionally present spacer group that is selected from —$(CH_2)_n$—, where n=0 to 4, —COO—$(CH_2)_k$—, where k=1 to 6, —C(O)—NH—$C(CH_3)_2$—, —C(O)—NH—$C(CH_3)_2$—$CH_2$— and —C(O)—NH—$CH(CH_3)$—$CH_2$—.

Amongst said monomers, those of formulas $$H_2C{=}CH{-}X{-}SO_3H,\ H_2C{=}C(CH_3){-}X{-}SO_3H \text{ or } HO_3S{-}X{-}(R^6)C{=}C(R^7){-}X{-}SO_3H$$

are preferred, in which $R^6$ and $R^7$, independently of one another, are selected from —H, —$CH_3$, —$CH_2CH_3$, —$CH_2CH_2CH_3$ and —$CH(CH_3)_2$, and X represents an optionally present spacer group that is selected from —$(CH_2)_n$—, where n=0 to 4, —COO—$(CH_2)_k$—, where k=1 to 6, —C(O)—NH—$C(CH_3)_2$—, —C(O)—NH—C$(CH_3)_2$—$CH_2$— and —C(O)—NH—$CH(CH_3)$—$CH_2$—.

According to a particularly preferred embodiment, the gel phase comprises a polymer comprising, as a sulfonic acid group-containing monomer, acrylamidopropanesulfonic acids, methacrylamidomethylpropanesulfonic acids or acrylamidomethylpropanesulfonic acid.

Particularly preferred sulfonic acid group-containing monomers are 1-acrylamido-1-propanesulfonic acid, 2-acrylamido-2-propanesulfonic acid, 2-acrylamido-2-methyl-1-propanesulfonic acid, 2-methacrylamido-2-methyl-1-propanesulfonic acid, 3-methacrylamido-2-hydroxypropanesulfonic acid, allyl sulfonic acid, methallyl sulfonic acid, allyloxybenzene sulfonic acid, methallyloxybenzene sulfonic acid, 2-hydroxy-3-(2-propenyloxy)propanesulfonic acid, 2-methyl-2-propene-1-sulfonic acid, styrene sulfonic acid, vinylsulfonic acid, 3-sulfopropyl acrylate, 3-sulfopropyl methacrylate, sulfomethacrylamide, sulfomethylmethacrylamide, as well as mixtures of the above acids or water-soluble salts thereof. The sulfonic acid groups can be present in the polymers in a fully or partially neutralized form, i.e. the acidic hydrogen atom of the sulfonic acid group can be replaced in some or all of the sulfonic acid groups with metal ions, preferably alkali metal ions, and in particular with sodium ions. The use of partially or fully neutralized sulfonic acid group-containing copolymers is preferred according to the invention.

In copolymers that contain only carboxylic acid group-containing monomers and sulfonic acid group-containing monomers, the monomer distribution of the copolymers that are preferably used according to the invention is preferably 5 to 95 wt. % in each case; particularly preferably, the proportion of the sulfonic acid group-containing monomer is 50 to 90 wt. %, and the proportion of the carboxylic acid group-containing monomer is 10 to 50 wt. %, with the monomers preferably being selected from those mentioned above. The molar mass of the sulfo-copolymers that are preferably used according to the invention can be varied in order to adapt the properties of the polymers to the desired intended use. Preferred cleaning agents are characterized in that the copolymers have molar masses from 2,000 to 200,000 $g \cdot mol^{-1}$, preferably from 4,000 to 25,000 $g \cdot mol^{-1}$ and in particular from 5,000 to 15,000 $g \cdot mol^{-1}$.

In another preferred embodiment, the copolymers comprise not only carboxyl group-containing monomers and sulfonic acid group-containing monomers but also at least one non-ionic, preferably hydrophobic monomer. In particular the rinsing performance of dishwashing detergents according to the invention was able to be improved by using these hydrophobically modified polymers.

Particularly preferably, the at least one gel phase further comprises an anionic copolymer, a copolymer comprising i) carboxylic acid group-containing monomers ii) sulfonic acid group-containing monomers iii) non-ionic monomers, in particular hydrophobic monomers being used as the anionic copolymer.

As the non-ionic monomers, monomers of general formula $$R^1(R^2)C{=}C(R^3)—X—R^4$$

are preferably used, in which $R^1$ to $R^3$ represent, independently of one another, —H, —$CH_3$ or —$C_2H_5$, X represents an optionally present spacer group selected from —$CH_2$—, —C(O)O— and —C(O)—NH—, and $R^4$ represents a straight-chain or branched saturated alkyl functional group having 2 to 22 carbon atoms or an unsaturated, preferably aromatic functional group having 6 to 22 carbon atoms.

Particularly preferred non-ionic monomers are butene, isobutene, pentene, 3-methylbutene, 2-methylbutene, cyclopentene, hexene, hexene-1,2-methlypentene-1,3-methlypentene-1, cyclohexene, methylcyclopentene, cycloheptene, methylcyclohexene, 2,4,4-trimethylpentene-1,2,4,4-trimethylpentene-2,2,3-dimethylhexene-1,2,4-dimethylhexene-1,2,5-dimethylhexene-1,3,5-dimethylhexene-1,4,4-dimethylhexane-1, ethylcyclohexene, 1-octene, α-olefins having 10 or more carbon atoms such as 1-decene, 1-dodecene, 1-hexadecene, 1-octadecene and $C_{22}$ α-olefin, 2-styrene, α-methylstyrene, 3-methylstyrene, 4-propylstyrene, 4-cyclohexylstyrene, 4-dodecylstyrene, 2-ethyl-4-benzylstyrene, 1-vinyl naphthalene, 2-vinyl naphthalene, acrylic acid methyl ester, acrylic acid ethyl ester, acrylic acid propyl ester, acrylic acid butyl ester, acrylic acid pentyl ester, acrylic acid hexyl ester, methacrylic acid methyl ester, N-(methyl)acrylamide, acrylic acid-2-ethylhexyl ester, methacrylic acid-2-ethylhexyl ester, N-(2-ethylhexyl)acrylamide, acrylic acid octyl ester, methacrylic acid octyl ester, N-(octyl)acrylamide, acrylic acid lauryl ester, methacrylic acid lauryl ester, N-(lauryl)acrylamide, acrylic acid stearyl ester, methacrylic acid stearyl ester, N-(stearyl)acrylamide, acrylic acid behenyl ester, methacrylic acid behenyl ester, and N-(behenyl)acrylamide or mixtures thereof, in particular acrylic acid, ethyl acrylate, 2-acrylamido-2-methylpropanesulfonic acid (AMPS) as well as mixtures thereof.

Surprisingly, PVOH and/or derivatives thereof together with anionic polymers or copolymers, in particular with sulfonic acid group-containing copolymers, have also been found to lead to the formation of gel phases with insensitive surfaces. Such surfaces can be touched by an end consumer without having material adhere to their hands. No erosion of material occurs in packaging either. The gel phase therefore preferably comprises PVOH, polyethylene glycol(s) having an average molar mass of 200 to 600 g/mol, at least one polyhydric alcohol, and an anionic copolymer/polymer. The proportion of the anionic polymer is preferably 1 wt. % to 35 wt. %, in particular 3 wt. % to 30 wt. %, in particular 4 wt. % to 25 wt. %, preferably 5 wt. % to 20 wt. %, for example 10 wt. %, based on the total weight of the gel phase. Sulfopolymers, in particular the preferred copolymeric polysulfonates, which, in addition to sulfonic acid group-containing monomer(s), also contain at least one monomer from the group of unsaturated carboxylic acids, in particular acrylic acid, also provide an excellent shine on the surface. What is more, fingerprints are not left behind. Therefore, the proportion of sulfopolymers, in particular the preferred copolymeric polysulfonates which contain not only sulfonic acid group-containing monomer(s) but also at least one monomer from the group of unsaturated carboxylic acids, in particular acrylic acid, in particular the proportion of said sulfopolymers having AMPS as a sulfonic acid group-containing monomer, for example Acusol 590, Acusol 588 or Sokalan CP50, is preferably 1 wt. % to 25 wt. %, in particular 3 wt. % to 18 wt. %, particularly 4 wt. % to 15 wt. %, preferably 5 wt. % to 12 wt. %, based on the weight of the gel phase. In a particularly preferred embodiment, therefore, the at least one gel phase comprises PVOH and a sulfopolymer, in particular the preferred copolymeric polysulfonates which contain not only sulfonic acid group-containing monomer(s) but also at least one monomer from the group of unsaturated carboxylic acids, in particular acrylic acid, and at least one polyhydric alcohol.

According to another embodiment, in addition to said polyethylene glycols having an average molar mass of from 200 to 600 g/mol, further polyalkylene glycols, in particular further polyethylene glycols, having an average molar mass of between approximately 800 and 8,000 may be contained in the at least one gel phase. The above-mentioned polyethylene glycols are particularly preferably used in quantities of from 1 to 40 wt. %, preferably from 5 to 35 wt. %, in particular from 10 to 30 wt. %, for example from 15 to 25 wt. %, preferably in each case based on the total weight of the gel phase.

Particularly preferred embodiments of the present invention comprise, as at least one gel phase, in each case based on the total weight of the gel phase, in addition to at least one non-ionic surfactant according to the invention, preferably in a quantity of from 0.5 to 10 wt. %, in particular from 0.8 to 8.5 wt. %, particularly preferably 1 to 7 wt. %, for example from 1.0 to 4.0 wt. %, based on the total weight of the gel phase, 8 to 22 wt. % PVOH, 15 to 40 wt. % 1,3-propanediol, 20 to 40 wt. % glycerol, 5 to 15 wt. % sulfonic acid group-containing polyacrylate copolymer, and 8 to 22 wt. %, in particular 10 to 20 wt. %, polyethylene glycol having an average molar mass of 200-600 g/mol, optionally 2 to 10 wt. % 1,2-propanediol, and optionally also 2-15 wt. % of triethylene glycol, in each case based on the total weight of the gel phase.

According to another particularly preferred embodiment, the cleaning agent, preferably dishwashing detergent, in particular automatic dishwashing detergent, is a cleaning agent portion in a water-soluble wrapping having one or more chambers/compartments. The cleaning agent is preferably packaged as a single-use cleaning agent portion, such that it is used to carry out a dishwasher cycle and is (as far as possible) substantially consumed in the process.

The water-soluble wrapping is preferably made from a water-soluble film material, which is selected from the group consisting of polymers or polymer mixtures. The wrapping may be made up of one or of two or more layers of the water-soluble film material. The water-soluble film material of the first layer and of the additional layers, if present, may be the same or different.

It is preferable for the water-soluble wrapping to contain polyvinyl alcohol or a polyvinyl alcohol copolymer. Water-soluble wrappings containing polyvinyl alcohol or a polyvinyl alcohol copolymer exhibit good stability with a sufficiently high level of water solubility, in particular cold-water solubility.

Suitable water-soluble films for preparing the water-soluble wrapping are preferably based on a polyvinyl alcohol or a polyvinyl alcohol copolymer of which the molecular weight is in the range of from 10,000 to 1,000,000 $gmol^{-1}$, preferably 20,000 to 500,000 $gmol^{-1}$, particularly preferably 30,000 to 100,000 $gmol^{-1}$ and in particular 40,000 to 80,000 $gmol^{-1}$.

Polyvinyl alcohol is usually prepared by hydrolysis of polyvinyl acetate, since the direct synthesis route is not possible. The same applies to polyvinyl alcohol copolymers, which are prepared accordingly from polyvinyl acetate copolymers. It is preferable for at least one layer of the water-soluble wrapping to include a polyvinyl alcohol of which the degree of hydrolysis is 70 to 100 mol. %, preferably 80 to 90 mol. %, particularly preferably 81 to 89 mol. %, and in particular 82 to 88 mol. %.

In a preferred embodiment, the water-soluble packaging consists of at least 20 wt. %, particularly preferably at least 40 wt. %, very particularly preferably at least 60 wt. %, and in particular at least 80 wt. % of a polyvinyl alcohol of which the degree of hydrolysis is 70 to 100 mol. %, preferably 80 to 90 mol. %, particularly preferably 81 to 89 mol. %, and in particular 82 to 88 mol. %.

In addition, a polymer selected from the group including (meth)acrylic acid-containing (co)polymers, polyacrylamides, oxazoline polymers, polystyrene sulfonates, polyurethanes, polyesters, polyethers, polylactic acid or mixtures of said polymers may be added to a polyvinyl alcohol-containing film material that is suitable for producing the water-soluble wrapping. Polylactic acids are a preferred additional polymer.

Preferred polyvinyl alcohol copolymers include, in addition to vinyl alcohol, dicarboxylic acids as further monomers. Suitable dicarboxylic acids are itaconic acid, malonic acid, succinic acid and mixtures thereof, with itaconic acid being preferred. Polyvinyl alcohol copolymers which include, in addition to vinyl alcohol, an ethylenically unsaturated carboxylic acid, or the salt or ester thereof, are also preferred. Polyvinyl alcohol copolymers of this kind particularly preferably contain, in addition to vinyl alcohol, acrylic acid, methacrylic acid, acrylic acid ester, methacrylic acid ester or mixtures thereof.

It may be preferable for the film material to contain further additives. The film material may contain plasticizers such as dipropylene glycol, ethylene glycol, diethylene glycol, propylene glycol, glycerol, sorbitol, mannitol or mixtures thereof, for example. Further additives include for example release aids, fillers, cross-linking agents, surfactants, antioxidants, UV absorbers, anti-blocking agents, anti-adhesive agents or mixtures thereof.

Suitable water-soluble films for use in the water-soluble wrappings of the water-soluble packaging according to the invention are films which are sold by MonoSol LLC, for example under the names M8720, M8630, M8312, M8440, M7062, C8400 or M8900. Films which are sold under the names SH2601, SH2504, SH2707 or SH2701 by Nippon Gohsei are also suitable. Other suitable films include films named Solublon® PT, Solublon® GA, Solublon® KC or Solublon® KL from Aicello Chemical Europe GmbH, or the VF-HP films from Kuraray.

The water-soluble wrapping preferably has, at least in part, a bitter principle having a bitter value of between 1,000 and 200,000, especially those selected from quinine sulfate (bitter value=10,000), naringin (bitter value=10,000), sucrose octaacetate (bitter value=100,000), quinine hydrochloride and mixtures thereof. In particular, the outer surface of the water-soluble wrapping is coated at least in part with a bitter principle having a bitter value of between 1,000 and 200,000. In this connection, it is particularly preferable for the water-soluble wrapping to be coated by at least 50%, preferably at least 75%, and very particularly preferably at least 90%, with the bitter principle having a bitter value of between 1,000 and 200,000. The application of the bitter principle having a bitter value of between 1,000 and 200,000 can take place for example by means of printing, spraying or spreading.

According to the invention, the water-soluble wrapping has at least one continuous peripheral sealing seam that lies substantially in one plane. This is favorable from a process point of view since only a single sealing step, possibly using only a single sealing tool, is required for a peripheral sealing seam that lies substantially in one plane. The continuous circumferential sealing seam leads to better closure compared with those wrappings having a plurality of sealing seams and to excellent sealing of the sealed seam and thus of the wrapping itself. The product leaking out of the wrapping, e.g. onto the surface of the portion, would be detrimental as the consumer would then come into contact with the product. Precisely this situation should be avoided as far as possible with a cleaning agent portion comprising a water-soluble wrapping.

The water-soluble wrapping may preferably be produced from at least two packaging parts. Preferably, the at least two packaging parts are water-soluble, so that no packaging parts remain in the dishwasher, which can then lead to problems in the dishwasher. The at least two packaging parts do not have to be different. They may preferably be produced from the same material and in the same way. In a preferred embodiment, these are two parts of a water-soluble film, in particular two parts of a water-soluble film of the same composition.

In another embodiment, the at least two packaging parts can be made of different materials, e.g. of different films or of material having two different properties (e.g. film that is soluble in hot and cold water). In this embodiment, it is preferable for a water-soluble film and another packaging part produced by injection molding to be combined.

According to a particularly preferred embodiment of the present invention, the water-soluble wrapping comprises at least one at least partly plastically deformed film. In particular, this plastic deformation of the film can be produced by methods known to a person skilled in the art, such as deep-drawing (with and without application of a vacuum), blowing or stamping. In particular, the water-soluble wrapping comprises at least one at least partly plastically deformed film which has been produced by deep-drawing.

The at least one solid phase and the at least one gel phase can be arranged within the water-soluble envelope in any combination with each other. A solid phase can thus be arranged on or beside a gel phase. In this embodiment, the cleaning agent according to the invention comprises a solid phase and a gel phase. It is also conceivable for a solid phase to be surrounded by gel phases. The embedding of one phase in another is also covered by the invention. In a further, particularly preferred arrangement, the gel phase is in cast form, for example in the form of a gel core, and is surrounded by the solid phase. Two or more cavities that are separated from one another can also be present which are filled with the at least one gel phase. In this embodiment, the cleaning agent comprises two gel phases, it being possible for the two gel phases to have different compositions.

According to a preferred embodiment, three, four, five or six or more cavities that are separated from one another are present which are filled with one or more of the gel phases. Preferably, those cleaning agents comprise three, four, five or six or more gel phases, it being possible for said gel phases to have the same or different compositions.

A preferred subject of the present invention is a cleaning agent, preferably a dishwashing detergent, in particular an automatic dishwashing detergent, which additionally comprises at least one solid, in particular particulate phase and optionally at least one other liquid/gel or solid phase.

"Solid" in this context means that the composition is in solid form under standard conditions (temperature 25° C., pressure 1013 mbar). Suitable solid phases are, on the one hand, granular mixtures of a solid composition, such as powders and/or granular material, in particular powdered phases. According to the invention, solid compositions/phases which have an increased dimensional stability compared with the loose powder, for example powder or granular-material preparations which have been compacted by compression before or after introduction into the film, e.g. by restoring forces of the film after deep-drawing, or also directly compressed compositions, such as compressed products or tablets, are also suitable. This at least one solid phase can be in direct contact with the gel phase. According to the invention, cleaning agent portions, in particular multi-chamber bags, in which the solid and gel phases are spatially close to one another but separate from one another are also used. The two chambers can for example be separated by a film, in particular a water-soluble film, or by a sealed seam (preferably a sealed seam of 3 mm or less). According to the invention, the chambers of a multi-chamber pouch are therefore on top of one another as well as beside one another. Furthermore, mixtures of single-chamber or multi-chamber bags which comprise a gel phase according to the invention and, separated therefrom, at least one solid phase, which come into contact by arrangement, e.g. by folding and fixing a pouch, or by storage at a distance of less than 3 mm, for example in a packaging bag or a device for portioned metering, are also in accordance with the invention.

Within the meaning of the present invention, a powdered phase is understood to mean a granular mixture which is formed from a large number of loose, solid particles, which in turn comprise what are known as grains. According to the invention, the term powdered phase covers powders and/or granular materials according to the following definition.

A grain is a name for the particulate constituents of powders (grains are the loose, solid particles), dusts (grains are the loose, solid particles), granular material (loose, solid particles are agglomerates of several grains), and other granular mixtures. A preferred embodiment of the granular mixture of the composition of the solid phase is the powder and/or the granular material; when reference is made to "powder" or "granular material," this also includes these being mixtures of different powders or different granular materials. Accordingly, powder and granular material are also intended to mean mixtures of different powders with different granular materials. Said solid particles of the granular mixture in turn preferably have a particle diameter $X_{50.3}$ (volume average) of from 10 to 1,500 μm, more preferably from 200 μm to 1,200 μm, particularly preferably from 600 μm to 1,100 μm. Said particle sizes can be determined by sieving or by means of a Camsizer particle size analyzer from the company Retsch. The granular mixture of the solid composition of the present invention serving as a solid phase is preferably present in free-flowing form (especially as free-flowing powder and/or free-flowing granular material). The average of the portion according to the invention therefore comprises at least one solid phase of a free-flowing granular mixture of a solid composition, in particular a powder, and at least one gel phase as previously defined.

A particularly preferred subject of the present invention is cleaning agents, in particular cleaning agent portions, in which the gel phase is in direct contact, for example in a chamber containing at least one solid phase.

Moreover, it is preferable for the at least one solid phase and the at least one gel phase to be in direct contact with one another. In this case, there should no negative interaction between the solid phase and the gel phase. What no negative interaction means here, for example, is that no ingredients or solvents go from one phase into the other or that the stability, in particular storage stability, preferably for 4 weeks and at a storage temperature of 30° C., and/or the esthetics of the product are not impaired in any way, for example through a change in color, the formation of wet-looking edges, a blurred boundary between the two phases, or the like.

Surprisingly, it has been shown that this objective can be achieved by formulating a gel phase, preferably a dimensionally stable gel phase, comprising at least one non-ionic surfactant according to the invention, preferably in a quantity of from 0.5 to 10 wt. %, in particular from 0.8 to 8.5 wt.

%, particularly preferably 1 to 7 wt. %, for example from 1.0 to 4.0 wt. %, based on the total weight of the gel phase, which is combined with a granular mixture of a solid composition, in particular a powdered phase. It is particularly suitable for the granular mixture of a solid composition, in particular the powdered phase, to be free-flowing, because, owing to the process, it is possible to fill the water-soluble wrapping in a more targeted manner, in particular when filling a cavity produced by deep-drawing. In addition, the visual appearance of the granular mixture of a solid composition, in particular the powder, can be better changed compared with a compressed tablet; in particular texture differences, such as coarse and fine particles and particles or regions having different colors—in full or as colored flecks—can be used to improve a visually pleasing appearance. In addition, the granular mixture of the solid composition, in particular the powder, offers improved solubility in comparison with compressed tablets, even without the addition of disintegrants.

Within the meaning of the present invention, a phase is a spatial region in which physical parameters and the chemical composition are homogeneous. One phase differs from another phase through its different features, such as ingredients, physical properties, external appearance, etc. Preferably, different phases can be differentiated visually from one another. The at least one solid phase can thus be clearly distinguished by a consumer from the at least one gel phase. If the cleaning agent according to the invention has more than one solid phase, then they can also each be distinguished from one another with the naked eye because of their different coloration, for example. The same applies if two or more gel phases are present. In this case as well, a visual differentiation of the phases, for example on the basis of a difference in coloration or transparency, is possible. Within the meaning of the present invention, phases are thus self-contained regions that can be differentiated visually from one another by a consumer with the naked eye. The individual phases can have different properties when used, such as the speed at which the phase dissolves in water and hence the speed and the sequence of the release of the ingredients contained in the particular phase.

The at least one solid phase of the present invention comprises a granular mixture of a solid composition; in particular, it is powdered and free-flowing. The cleaning agent according to the invention thus comprises at least one solid powdered phase and one free-flowing phase, and at least one gel phase, which comprises at least one non-ionic surfactant according to the invention, preferably in a quantity of from 0.5 to 10 wt. %, in particular from 0.8 to 8.5 wt. %, particularly preferably 1 to 7 wt. %, for example from 1.0 to 4.0 wt. %, based on the total weight of the gel phase, and at least PVOH, and at least one polyhydric alcohol.

The free-flowing ability of a granular mixture, in particular a powdered solid, the powdered phase, preferably the powder and/or granular material, relates to its ability to flow freely under its own weight. The free-flowing ability is determined by the outflow time of 1,000 ml of cleaning agent powder out of a standardized flow-test funnel, which is initially closed in its discharge direction and has an outlet of 16.5 mm in diameter, being measured by measuring the time for the complete outflow of the granular mixture, in particular the powdered phase, preferably the powder and/or granular material, e.g. the powder, after opening the outlet, and being compared with the outflow speed (in seconds) of a standard test sand of which the outflow speed is defined as 100%. The defined sand mixture for calibrating the flow apparatus is dry sea sand. In this case, sea sand having a particle diameter of from 0.4 to 0.8 mm is used, as is available for example from Carl Roth, Germany CAS no. [14808-60-7]. For drying, the sea sand is dried, before the measurement for 24 h at 60° C., in a drying cabinet on a plate at a maximum layer height of 2 cm.

Preferred embodiments of the solid phases according to the invention have an angle of repose/angle of slope of from 26 to 35, from 27 to 34, from 28 to 33, the angle of repose being determined according to the method mentioned below after 24 h following the preparation of the granular mixture of the solid composition, in particular the powdered solid phase, preferably the powder and/or granular material, and storage at 20° C. Such angles of repose have the advantage that the cavities can be filled with the at least one solid phase comparatively quickly and precisely.

To determine the angle of repose (also referred to as the angle of slope) of the at least one solid phase, a powder funnel having a capacity of 400 ml and an outlet having a diameter of 25 mm is simply suspended in a tripod. The funnel is moved upwards by means of a manually operated knurling wheel at a speed of 80 mm/min such that the granular mixture, in particular the powdered phase, preferably the powder and/or granular material, e.g. the powder, flows out. As a result, what is known as a conical heap is formed. The conical heap height and the conical heap diameter are determined for the individual solid phases. The angle of slope is calculated from the quotient of the conical heap height and the conical heap diameter*100.

Granular mixtures of a solid composition, in particular powdered phases, preferably the powders and/or granular materials, e.g. the powders, having a free-flowing ability in %, compared with the above-mentioned standard test substance, of greater than 40%, preferably greater than 50, in particular greater than 55%, more preferably greater than 60%, particularly preferably between 63% and 80%, for example between 65% and 75%, are particularly suitable. Granular mixtures of a solid composition, in particular powders and/or granular materials having a free-flowing ability in %, compared with the above-mentioned standard test substance, of greater than 40%, preferably greater than 45%, in particular greater than 50%, more preferably greater than 55%, particularly preferably greater than 60%, are particularly suitable, the free-flowing ability being measured 24 hours following the preparation of the powder and storage at 20° C.

Lower values for the free-flowing ability are rather unsuitable, since from a process point of view, precise metering of the granular mixture, in particular the particulate phase, preferably the powder and/or granular material, e.g. the powder, is necessary. In particular, the values greater than 50%, in particular greater than 55%, preferably greater than 60% (where the measurement of the free-flowing ability is carried out 24 hours after the preparation of the powder and storage at 20° C.) have proved to be advantageous, since the good metering ability of the granular mixture, in particular the powdered phases, preferably the powders and/or granular materials, e.g. powder, leads to only minor fluctuations in the metered quantity or the composition. The more accurate metering leads to consistent product performance, and economic losses due to over-metering are thus avoided. It is further advantageous for the granular mixture, in particular the powdered phase, preferably the powder and/or granular material, e.g. the powder, to be well metered so that a faster sequence of the metering process can be achieved. In addition, such a good free-flowing ability makes it easier to avoid the situation whereby the granular mixture, in particular the powdered phase, preferably the powder and/or granular material, e.g. the powder, reaches the part of the water-soluble wrapping which is provided for producing the sealing seam and therefore ought to remain as free as possible of grains, in particular powder-free.

The granular mixture of the solid composition of the present invention serving as a solid phase is preferably present in free-flowing form (especially as free-flowing powder and/or free-flowing granular material). The agent in the portion according to the invention therefore comprises at least one solid phase of a free-flowing granular mixture of a solid composition, in particular a powder, and at least one gel phase as previously defined.

The cleaning agent according to the invention preferably comprises at least one additional surfactant in addition to the surfactant according to the invention. This surfactant is selected from the group of the anionic, non-ionic, and cationic surfactants. The cleaning agent according to the invention can also contain mixtures of several surfactants that are selected from the same group.

According to the invention, the at least one solid phase and/or the at least one gel phase comprise at least one surfactant. It is possible for only the at least one solid phase or only the at least one gel phase to comprise at least one surfactant. If both phases comprise a surfactant, then they are preferably surfactants that are different from one another. However, it is also possible that solid and gel phases have the same surfactant or surfactants. According to the invention, at least one solid and/or gel phase preferably contains at least one non-ionic surfactant. All non-ionic surfactants that are known to a person skilled in the art can be used as non-ionic surfactants. Low foaming non-ionic surfactants are preferably used, in particular alkoxylated, especially ethoxylated, low-foaming non-ionic surfactants such as alkyl glycosides, alkoxylated, preferably ethoxylated or ethoxylated and propoxylated fatty acid alkyl esters, polyhydroxy fatty acid amides, or amine oxides. Particularly preferred non-ionic surfactants are specified in greater detail below.

Preferred alcohol ethoxylates have a narrowed homolog distribution (narrow range ethoxylates, NRE). In addition to these non-ionic surfactants, fatty alcohols having more than 12 EO can also be used. Examples of these are tallow fatty alcohols having 14 EO, 25 EO, 30 EO, or 40 EO.

Ethoxylated non-ionic surfactants are particularly preferably used which were obtained from $C_{6-20}$ monohydroxy alkanols or $C_{6-20}$ alkyl phenols or $C_{16-20}$ fatty alcohols and more than 12 mol, preferably more than 15 mol, and in particular more than 20 mol, ethylene oxide per mol of alcohol. A particularly preferred non-ionic surfactant is obtained from a straight-chain fatty alcohol having 16 to 20 carbon atoms ($C_{16-20}$ alcohol), preferably from a $C_{18}$ alcohol and at least 12 mol, preferably at least 15 mol and in particular at least 20 mol, ethylene oxide. Among these, what are referred to as "narrow range ethoxylates" are particularly preferred.

Surfactants that are preferably used come from the group of the alkoxylated non-ionic surfactants, in particular the ethoxylated primary alcohols and mixtures of these surfactants with structurally complex surfactants such as polyoxypropylene/polyoxyethylene/polyoxypropylene ((PO/EO/PO) surfactants). Such (PO/EO/PO) non-ionic surfactants are also characterized by good foam control.

In the context of the present invention, low-foaming non-ionic surfactants which have alternating ethylene oxide and alkylene oxide units have proven to be particularly preferred. Among these, in turn, surfactants having EO-AO-EO-AO blocks are preferred, with one to ten EO groups and AO groups being bonded to each other in each case, before a block follows from the other group. Here, non-ionic surfactants of general formula $$R^1-O-(CH_2-CH_2-O)_w-(CH_2-\underset{\underset{R^2}{|}}{CH}-O)_x-(CH_2-CH_2-O)_y-(CH_2-\underset{\underset{R^3}{|}}{CH}-O)_z-H$$

are preferred, in which $R^1$ represents a straight-chain or branched, saturated or mono- or polyunsaturated $C_{6-24}$ alkyl or alkenyl functional group; each $R^2$ and $R^3$ group is selected, independently of one another, from $-CH_3$, $-CH_2CH_3$, $-CH_2CH_2-$, $CH_3$, $-CH(CH_3)_2$, and the indices w, x, y, z, independently of one another, represent integers from 1 to 6.

Preferred non-ionic surfactants of the above formula can be produced, using known methods, from the corresponding alcohols $R^1$—OH and ethylene or alkylene oxide. The $R^1$ functional group in the above formula can vary depending on the origin of the alcohol. If native sources are used, the functional group $R^1$ has an even number of carbon atoms and is generally unbranched, the linear functional groups consisting of alcohols of native origin with 12 to 18 C atoms, for example coconut, palm, tallow fat or oleyl alcohol, being preferred. Some examples of alcohols that are available from synthetic sources are the Guerbet alcohols or functional groups that are methyl-branched or linear and methyl-branched in the 2 position in admixture, such as those usually present in oxo-alcohol functional groups. Independently of the approach taken in the preparation of the alcohol used in the non-ionic surfactants contained in the agents, non-ionic surfactants are preferred in which $R^1$ represents an alkyl functional group having 6 to 24, preferably 8 to 20, particularly preferably 9 to 15, and in particular 9 to 11 carbon atoms in the above formula.

Besides propylene oxide, butylene oxide in particular is worthy of consideration as an alkylene oxide unit that is contained alternately with the ethylene oxide unit in the preferred non-ionic surfactants. However, other alkylene oxides in which $R^2$ and $R^3$ are selected, independently of one another, from $-CH_2CH_2-CH_3$ and $-CH(CH_3)_2$ are also suitable. Preferably, non-ionic surfactants of the above formula are used in which $R^2$ and $R^3$ represent a $-CH_3$ functional group; w and x represent, independently of one another, values of 3 or 4; and y and z represent, independently of one another, values of 1 or 2.

Further preferably used non-ionic surfactants of the solid phase are non-ionic surfactants of general formula $$R^1O(AlkO)_xM(OAlk)_yOR^2,$$

where $R^1$ and $R^2$ represent, independently of one another, a branched or unbranched, saturated or unsaturated, optionally hydroxylated alkyl functional group having 4 to 22 carbon atoms; Alk represents a branched or unbranched alkyl functional group having 2 to 4 carbon atoms; x and y represent, independently of one another, values of between 1 and 70; and M represents an alkyl functional group from the group $CH_2$, $CHR^3$, $CR^3R^4$, $CH_2CHR^3$ and $CHR^3CHR^4$, where $R^3$ and $R^4$ represent, independently of one another, a branched or unbranched, saturated or unsaturated alkyl functional group having 1 to 18 carbon atoms.

Preferred in this case are non-ionic surfactants of general formula $$R^1—CH(OH)CH_2—O(CH_2CH_2O)_xCH_2CHR(OCH_2CH_2)_y—CH_2CH(OH)—R^2,$$

where R, $R^1$ and $R^2$, independently of one another, represent an alkyl functional group or alkenyl functional group having 6 to 22 carbon atoms; x and y, independently of one another, represent values of between 1 and 40.

Preferred in this case are, in particular, compounds of general formula $$R^1—CH(OH)CH_2—O(CH_2CH_2O)_xCH_2CHR(OCH_2CH_2)yO\text{-}CH_2CH(OH)—R^2,$$

in which R represents a linear, saturated alkyl functional group having 8 to 16 carbon atoms, preferably 10 to 14 carbon atoms, and n and m represent, independently of one another, values of from 20 to 30. Such compounds can be obtained, for example, by reacting alkyl diols HO—CHR—$CH_2$—OH with ethylene oxide, with a reaction with an alkyl epoxide being performed subsequently in order to close the free OH functions whilst forming a dihydroxy ether.

In this case, preferred non-ionic surfactants are those of general formula $$R^1—CH(OH)CH_2O\text{-}(AO)_w\text{-}(A'O)_x\text{-}(A''O)_y\text{-}(A'''O)_z—R^2, \text{ in which}$$

- $R^1$ represents a straight-chain or branched, saturated or mono- or polyunsaturated $C_6$-24 alkyl or alkenyl functional group;
- $R^2$ represents hydrogen or a linear or branched hydrocarbon functional group having 2 to 26 carbon atoms;
- A, A', A" and A"' represent, independently of one another, a functional group from the group —$CH_2CH_2$, —$CH_2CH_2$—$CH_2$, —$CH_2$—$CH(CH_3)$, —$CH_2$—$CH_2$—$CH_2$—$CH_2$, —$CH_2$—$CH(CH_3)$—$CH_2$—, —$CH_2$—$CH(CH_2$—$CH_3)$;
- w, x, y and z represent values of between 0.5 and 120, where x, y and/or z can also be 0.

By adding the above-mentioned non-ionic surfactants of general formula $$R^1—CH(OH)CH_2O)_w\text{-}(A'O)_x\text{-}(A''O)_y\text{-}(A'''O)_z—R^2,$$

subsequently also referred to as 'hydroxy mixed ethers', surprisingly, the cleaning performance of preparations according to the invention can be significantly improved, both in comparison with surfactant-free systems and in comparison with systems containing alternative non-ionic surfactants, for example from the group of polyalkoxylated fatty alcohols.

By using these non-ionic surfactants having one or more free hydroxyl groups on one or both terminal alkyl functional groups, the stability of the enzymes contained in the cleaning agent preparations according to the invention can be improved substantially.

In particular, those end-capped poly(oxyalkylated) non-ionic surfactants are preferred which, according to the following formula,

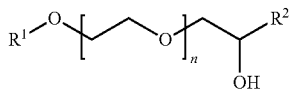

besides a functional group $R^1$, which represents linear or branched, saturated or unsaturated, aliphatic or aromatic hydrocarbon functional groups having 2 to 30 carbon atoms, preferably having 4 to 22 carbon atoms, also have a linear or branched, saturated or unsaturated, aliphatic or aromatic hydrocarbon functional group $R^2$ having 1 to 30 carbon atoms, where n represents values of between 1 and 90, preferably values of between 10 and 80, and in particular values of between 20 and 60. Surfactants of the above formula are particularly preferred in which $R^1$ represents $C_7$ to $C_{13}$, n represents a whole natural number from 16 to 28 and $R^2$ represents $C_8$ to $C_{12}$.

Surfactants of formula $$R^1O[CH_2CH(CH_3)O]_x[CH_2CH_2O]_yCH_2CH(OH)R^2$$

are particularly preferred, in which $R^1$ represents a linear or branched aliphatic hydrocarbon functional group having 4 to 18 carbon atoms or mixtures thereof, $R^2$ denotes a linear or branched hydrocarbon functional group having 2 to 26 carbon atoms or mixtures thereof, x represents values of between 0.5 and 1.5, and y represents a value of at least 15. The group of these non-ionic surfactants includes for example the $C_{2-26}$ fatty alcohol $(PO)_1$-$(EO)_{15-40}$-2-hydroxyalkyl ethers, in particular including the $C_{8-10}$ fatty alcohol $(PO)_1$-$(EO)_{22}$-2-hydroxydecyl ethers.

In particular, those end-capped poly(oxyalkylated) non-ionic surfactants of formula $$R^1O[CH_2CH_2O]_x[CH_2CH(R^3)O]_yCH_2CH(OH)R^2$$

are preferred, in which $R^1$ and $R^2$ represent, independently of one another, a linear or branched, saturated or mono- or polyunsaturated hydrocarbon functional group having 2 to 26 carbon atoms, $R^3$ is selected, independently of one another, from —$CH_3$, —$CH_2CH_3$, —$CH_2CH_2$—$CH_3$, —$CH(CH_3)_2$, but preferably represents —$CH_3$, and x and y represent, independently of one another, values of between 1 and 32, with non-ionic surfactants where $R^3$=—$CH_3$ and having values for x of from 15 to 32 and for y of from 0.5 and 1.5 being very particularly preferred.

Additional nonionic surfactants that can be preferably used are the end-capped poly(alkoxylated) non-ionic surfactants of formula $$R^1O[CH_2CH(R^3)O]_x[CH_2]_kCH(OH)[CH_2]_jOR^2,$$

in which $R^1$ and $R^2$ represent linear or branched, saturated or unsaturated, aliphatic or aromatic hydrocarbon functional groups having 1 to 30 carbon atoms, $R^3$ represents H or a methyl, ethyl, n-propyl, iso-propyl, n-butyl, 2-butyl or 2-methyl-2-butyl functional group, x represents values between 1 and 30, and k and j represent values between 1 and 12, preferably between 1 and 5.

If the value is x>2, each $R^3$ in the above formula $$R^1O[CH_2CH(R^3)O]_x[CH_2]_kCH(OH)[CH_2]_jOR^2$$

can be different. $R^1$ and $R^2$ are preferably linear or branched, saturated or unsaturated, aliphatic or aromatic hydrocarbon functional groups having 6 to 22 carbon atoms, with functional groups having 8 to 18 C atoms being particularly preferred. For the functional group $R^3$, H, —$CH_3$ or —$CH_2CH_3$ are particularly preferred. Particularly preferred values for x are in the range of from 1 to 20, in particular from 6 to 15.

As described above, each $R^3$ in the above formula can be different if x>2. In this way, the alkylene oxide unit in square brackets can be varied. For example, if x represents 3, the functional group $R^3$ can be selected in order to form ethylene oxide ($R^3$=H) or propylene oxide ($R^3$=$CH_3$) units, which can be joined together in any sequence, for example (EO)(PO)(EO), (EO)(EO)(PO), (EO)(EO)(EO), (PO)(EO)(PO), (PO)(PO)(EO) and (PO)(PO)(PO). The value 3 for x has been selected here by way of example and can by all means be greater, in which case the range of variation increases as the values for x increase and includes a large number of (EO) groups combined with a small number of (PO) groups, for example, or vice versa.

Particularly preferred end-capped poly(oxyalkylated) alcohols of the above formula have values of k=1 and j=1, and therefore the previous formula is simplified to $R^1O[CH_2CH(R^3)O]XCH_2CH(OH)CH_2OR^2$. In the last-mentioned formula, $R^1$, $R^2$ and $R^3$ are as defined above and x represents numbers from 1 to 30, preferably from 1 to 20, and in particular from 6 to 18. Surfactants in which the functional groups $R^1$ and $R^2$ have 9 to 14 C atoms, $R^3$ represents H, and x assumes values from 6 to 15 are particularly preferred. Finally, the non-ionic surfactants of general formula $R^1—CH(OH)CH_2O-(AO)_w—R^2$ have proven to be particularly effective, in which

- $R^1$ represents a straight-chain or branched, saturated or mono- or polyunsaturated $C_6$-24 alkyl or alkenyl functional group;
- $R^2$ represents a linear or branched hydrocarbon functional group having 2 to 26 carbon atoms;
- A represents a functional group from the group $CH_2CH_2$, $CH_2CH_2CH_2$, $CH_2CH(CH_3)$, preferably $CH_2CH_2$, and
- w represents values between 1 and 120, preferably 10 to 80, particularly 20 to 40.

The group of these non-ionic surfactants includes, for example, the $C_{4-22}$ fatty alcohol-$(EO)_{10-80}$-2-hydroxyalkyl ethers, in particular including the $C_{8-12}$ fatty alcohol-$(EO)_{22}$-2-hydroxydecyl ethers and the $C_{4-22}$ fatty alcohol-$(EO)_{40-80}$-2-hydroxyalkyl ethers.

Preferably, the at least one solid and/or the at least one gel phase contains at least one non-ionic surfactant, preferably a non-ionic surfactant from the group of the hydroxy mixed ethers, with the proportion by weight of the non-ionic surfactant with respect to the total weight of the gel phase being preferably 0.5 wt. % to 30 wt. %, more preferably 5 wt. % to 25 wt. %, and in particular 10 wt. % to 20 wt. %.

In another preferred embodiment, the non-ionic surfactant of the solid and/or gel phase is selected from non-ionic surfactants of general formula $$R^1—O(CH_2CH_2O)_xCR^3R^4(OCH_2CH_2)_yO—R^2,$$

in which $R^1$ and $R^2$, independently of one another, represent an alkyl functional group or alkenyl functional group having 4 to 22 carbon atoms; $R^3$ and $R^4$ represent, independently of one another, H or an alkyl functional group of alkenyl functional group having 1 to 18 carbon atoms, and x and y represent, independently of one another, values between 1 and 40.

Preferred in this case are, in particular, compounds of general formula $$R^1—O(CH_2CH_2O)_xCR^3R^4(OCH_2CH_2)_yO—R^2,$$

in which $R^3$ and $R^4$ represent H and the indices x and y, independently of one another, assume values from 1 to 40, preferably from 1 to 15.

Particularly preferred are, in particular, compounds of general formula $$R^1—O(CH_2CH_2O)_xCR^3R^4(OCH_2CH_2)_yO—R^2,$$

in which the functional groups $R^1$ and $R^2$, independently of one another, represent saturated alkyl functional groups having 4 to 14 carbon atoms and the indices x and y, independently of one another, assume values from 1 to 15 and in particular from 1 to 12.

More preferred are those compounds of general formula $$R^1—O(CH_2CH_2O)_xCR^3R^4(OCH_2CH_2)_yO—R^2,$$

in which one of the functional groups $R^1$ and $R^2$ is branched.

Most particularly preferred are compounds of general formula $$R^1—O(CH_2CH_2O)_xCR^3R^4(OCH_2CH_2)_yO—R^2,$$

in which the indices x and y, independently of one another, assume values from 8 to 12.

The indicated C chain lengths and degrees of ethoxylation or degrees of alkoxylation of the non-ionic surfactants represent statistical averages that can be an integer or a fraction for a given product. Owing to the manufacturing methods, commercial products of the above-mentioned formulas generally do not consist of an individual representative, but of mixtures, for which reason average values and, resulting from those, fractional numbers can arise both for the C chain lengths and for the degrees of ethoxylation and degrees of alkoxylation.

Naturally, the above-mentioned non-ionic surfactants can be used not only as individual substances but also as surfactant mixtures of two, three, four, or more surfactants.

Additional particularly preferred non-ionic surfactants to be used in the solid phase having melting points above room temperature contain 40 to 70% of a polyoxypropylene/polyoxyethylene/polyoxypropylene block polymer blend that contains 75 wt. % of a reverse block copolymer of polyoxyethylene and polyoxypropylene with 17 mol of ethylene oxide and 44 mol of propylene oxide and 25 wt. % of a block copolymer of polyoxyethylene and polyoxypropylene, initiated with trimethylolpropane and containing 24 mol of ethylene oxide and 99 mol of propylene oxide per mol of trimethylolpropane.

In one preferred embodiment, the proportion by weight of the non-ionic surfactant with respect to the total weight of the solid phase is from 0.1 to 20 wt. %, particularly preferably from 0.5 to 15 wt. %, and in particular from 2.5 to 10 wt. %.

All anionic surface-active substances are suitable for use as anionic surfactants in dishwashing detergents. These are characterized by a water-solubilizing, anionic group such as a carboxylate, sulfate or sulfonate group and a lipophilic alkyl group with about 8 to 30 carbon atoms. In addition, glycol ether or polyglycol ether groups, ester, ether and amide groups, and hydroxyl groups can be contained in the molecule. Suitable anionic surfactants are preferably present in the form of sodium, potassium and ammonium salts as well as mono-, di- and trialkanolammonium salts with 2 to 4 carbon atoms in the alkanol group, but zinc, manganese (II), magnesium, calcium or mixtures thereof may also serve as counterions.

Preferred anionic surfactants are alkyl sulfates, alkyl polyglycol ether sulfates, and ether carboxylic acids with 10 to 18 C atoms in the alkyl group and up to 12 glycol ether groups in the molecule.

Instead of the above-mentioned surfactants or in conjunction therewith, cationic and/or amphoteric surfactants such as betaines or quaternary ammonium compounds can also be used. It is preferred, however, that no cationic and/or amphoteric surfactants be used.

Preferred cleaning agents according to the invention are also characterized in that they contain, in the at least one solid and/or the at least one gel phase, in particular in the solid phase, less than 1.0 wt. % and in particular less than 0.1 wt. %, and preferably no anionic surfactant.

According to a particularly preferred embodiment, the cleaning agents according to the invention are characterized in that the at least one gel phase comprises less than 1 wt. %, in particular less than 0.5 wt. %, in particular less than 0.1 wt. %, anionic surfactant, in each case based on the total weight of the gel phase.

The at least one gel phase is preferably substantially free of anionic surfactants. Substantially free means that the at least one gel phase comprises less than 0.05 wt. % anionic surfactant, in each case based on the total weight of the gel phase.

It has been found in this context that the presence of 1 wt. % anionic surfactant in the at least one gel phase leads to poorer foaming behavior and poorer rinsing behavior of the overall composition. Furthermore, higher amounts of anionic surfactants adversely affect the curing. According to a particularly preferred embodiment, the gel phase contains less than 1 wt. %, preferably less than 0.5 wt. %, in particular less than 0.05 wt. %, fatty acid salts or soaps.

According to another embodiment, the at least one gel phase may contain sugar. According to the invention, sugars include sugar alcohols, monosaccharides, disaccharides, and oligosaccharides. In a preferred embodiment, the at least one gel phase comprises at least one sugar alcohol other than glycerol, preferably at least one monosaccharide or disaccharide sugar alcohol. In particular, mannitol, isomalt, lactitol, sorbitol, threitol, erythritol, arabitol, and xylitol are preferred. Particularly preferred monosaccharide sugar alcohols are pentitols and/or hexitols. Xylitol and/or sorbitol are very particularly preferred.

In another embodiment, the gel phase can comprise disaccharides, in particular sucrose. The sucrose fraction is 0 wt. % to 30 wt. %, in particular 5 wt. % to 25 wt. %, particularly preferably 10 wt. % to 20 wt. %, with respect to the weight of the gel phase. In greater quantities, the sugar does not dissolve completely in the gel phase and results in the clouding thereof. By using sugar, in particular in a proportion of from 10 wt. % to 15 wt. %, the development of moisture is reduced and the adhesion to the at least one solid phase is thus improved.

The use of builder substances (builders) such as silicates, aluminum silicates (particularly zeolites), salts of organic di- and polycarboxylic acids, as well as mixtures of these substances, preferably water-soluble builder substances, can be advantageous.

In an embodiment that is particularly preferred according to the invention, the use of phosphates (including polyphosphates) is omitted either largely or completely. In this embodiment, the agent preferably contains less than 5 wt. %, particularly preferably less than 3 wt. %, in particular less than 1 wt. %, phosphate(s). Particularly preferably, the agent in this embodiment is completely phosphate-free, i.e. the agents contain less than 0.1 wt. % phosphate(s).

The builders include, in particular, carbonates, citrates, phosphonates, organic builders, and silicates. The proportion by weight of the total builders with respect to the total weight of agents according to the invention is preferably 15 to 80 wt. % and in particular 20 to 70 wt. %.

Some examples of organic builders that are suitable according to the invention are the polycarboxylic acids (polycarboxylates) that can be used in the form of their sodium salts, with polycarboxylic acids being understood as being those carboxylic acids that carry more than one, in particular two to eight, acid functions, preferably two to six, in particular two, three, four, or five acid functions in the entire molecule. As polycarboxylic acids, dicarboxylic acids, tricarboxylic acids, tetracarboxylic acids, and pentacarboxylic acids, in particular di-, tri-, and tetracarboxylic acids, are thus preferred. The polycarboxylic acids can also carry additional functional groups such as hydroxyl or amino groups, for example. For example, these include citric acid, adipic acid, succinic acid, glutaric acid, malic acid, tartaric acid, maleic acid, fumaric acid, sugar acids (preferably aldaric acids, for example galactaric acid and glucaric acid), aminocarboxylic acids, in particular aminodicarboxylic acids, aminotricarboxylic acids, aminotetracarboxylic acids such as nitrilotriacetic acid (NTA), glutamic-N,N-diacetic acid (also called N,N-bis(carboxymethyl)-L-glutamic acid or GLDA), methyl glycine diacetic acid (MGDA) and derivatives thereof and mixtures thereof. Preferred salts are the salts of the polycarboxylic acids such as citric acid, adipic acid, succinic acid, glutaric acid, tartaric acid, GLDA, MGDA, and mixtures thereof.

Other substances that are suitable as organic builders are polymeric polycarboxylates (organic polymers with a plurality of (in particular greater than ten) carboxylate functions in the macromolecule), polyaspartates, polyacetals, and dextrins.

Besides their building effect, the free acids also typically have the quality of an acidification component. Particularly noteworthy here are citric acid, succinic acid, glutaric acid, adipic acid, gluconic acid, and any mixtures thereof.

Particularly preferred cleaning agents according to the invention, in particular dishwashing detergents, preferably automatic dishwashing detergents, contain one or more salts of citric acid, i.e. citrates, as one of their essential builders. These are preferably contained in a proportion of from 2 to 40 wt. %, in particular from 5 to 30 wt. %, particularly from 7 to 28 wt. %, particularly preferably from 10 to 25 wt. %, very particularly preferably from 15 to 20 wt. %, in each case based on the total weight of the agent.

It is also particularly preferred to use carbonate(s) and/or hydrogen carbonate(s), preferably alkali carbonate(s), particularly preferably sodium carbonate (soda), in quantities of from 2 to 50 wt. %, preferably from 4 to 40 wt. %, and in particular from 10 to 30 wt. %, very particularly preferably from 10 to 24 wt. %, in each case based on the weight of the agent.

Particularly preferred cleaning agents according to the invention, in particular dishwashing detergents, preferably automatic dishwashing detergents, are characterized in that they contain at least two builders from the group of silicates, phosphonates, carbonates, aminocarboxylic acids, and citrates, with the proportion by weight of these builders based on the total weight of the cleaning agent according to the invention being preferably 5 to 70 wt. %, more preferably 15 to 60 wt. %, and in particular 20 to 50 wt. %. The combination of two or more builders from the above-mentioned group has proven advantageous for the cleaning and rinsing performance of cleaning agents according to the invention, in particular dishwashing detergents, preferably automatic dishwashing detergents. Beyond the builders mentioned here, one or more additional builders can also be contained.

Preferred cleaning agents, in particular dishwashing detergents, preferably automatic dishwashing detergents, are characterized by a builder combination of citrate and carbonate and/or hydrogen carbonate. In one embodiment that is very particularly preferred according to the invention, a mixture of carbonate and citrate is used in which the quantity of carbonate is preferably from 5 to 40 wt. %, in particular from 10 to 35 wt. %, very particularly preferably from 15 to 30 wt. %, and the quantity of citrate is preferably from 5 to 35 wt. %, in particular from 10 to 25 wt. %, very particularly preferably from 15 to 20 wt. %, in each case based on the total quantity of the cleaning agent, with the total quantity of these two builders preferably being from 20 to 65 wt. %, in particular from 25 to 60 wt. %, preferably from 30 to 50 wt. %. Moreover, one or more additional builders can also be contained.

The cleaning agents according to the invention, in particular dishwashing detergents, preferably automatic dishwashing detergents, can contain phosphonates in particular as an additional builder. A hydroxy alkane and/or amino alkane phosphonate is preferably used as a phosphonate compound. Among the hydroxy alkane phosphonates, 1-hydroxyethane-1,1-diphosphonate (HEDP) has particular significance. Possible preferable aminoalkane phosphonates include ethylenediamine tetramethylene phosphonate (EDTMP), diethylenetriamine pentamethylene phosphonate (DTPMP) and the higher homologues thereof. Phosphonates are preferably contained in the agents according to the invention in quantities of from 0.1 to 10 wt. %, in particular in quantities of from 0.5 to 8 wt. %, very particularly preferably from 2.5 to 7.5 wt. %, in each case based on the total weight of the agent.

The combined use of citrate, (hydrogen) carbonate, and phosphonate is particularly preferred. These can be used in the above-mentioned quantities. In particular, quantities of 10 to 25 wt. % citrate, 10 to 30 wt. % carbonate (or hydrogen carbonate), and 2.5 to 7.5 wt. % phosphonate are used in this combination, in each case based on the total weight of the agent.

Additional particularly preferred cleaning agents, in particular dishwashing detergents, preferably automatic dishwashing detergents, are characterized in that, in addition to citrate and (hydrogen) carbonate and, optionally, phosphonate, they contain at least one additional phosphorus-free builder. In particular, it is selected from aminocarboxylic acids, with the additional phosphorus-free builder preferably being selected from methyl glycine diacetic acid (MGDA), glutamic acid diacetate (GLDA), aspartic acid diacetate (ASDA), hydroxyethyliminodiacetate (HEIDA), iminodisuccinate (IDS), and ethylenediamine disuccinate (EDDS), particularly preferably from MGDA or GLDA. An example of a particularly preferred combination is citrate, (hydrogen) carbonate, and MGDA as well as, optionally, phosphonate.

The proportion by weight of the additional phosphorus-free builder, in particular of the MGDA and/or GLDA, is preferably from 0 to 40 wt. %, in particular from 5 to 30 wt. %, more particularly from 7 to 25 wt. %. The use of MGDA or GLDA, in particular MGDA, as granular material is particularly preferred. Advantageous in this regard are MGDA granular materials that contain as little water as possible and/or have a lower hygroscopicity (water absorption at 25° C., normal pressure) than non-granulated powders. The combination of at least three, in particular at least four, builders from the above-mentioned group has proven advantageous for the cleaning and rinsing performance of cleaning agents according to the invention, in particular dishwashing detergents, preferably automatic dishwashing detergents. Besides those, additional builders can also be contained.

Polymeric polycarboxylates are also suitable as organic builders. These are, for example, the alkali metal salts of polyacrylic acid or polymethacrylic acid, for example those having a relative molecular mass of from 500 to 70,000 g/mol. Suitable polymers are in particular polyacrylates which preferably have a molecular mass of from 1,000 to 20,000 g/mol. Due to their superior solubility, the short-chain polyacrylates, which have molar masses of from 1,100 to 10,000 g/mol, and particularly preferably from 1,200 to 5,000 g/mol, can in turn be preferred from this group.

The content of (homo)polymeric polycarboxylates in the cleaning agents according to the invention, in particular dishwashing detergents, preferably automatic dishwashing detergents, is preferably 0.5 to 20 wt. %, preferably 2 to 15 wt. %, and in particular 4 to 10 wt. %.

Cleaning agents according to the invention, in particular dishwashing detergents, preferably automatic dishwashing detergents, can also contain, as a builder, crystalline layered silicates of general formula $NaMSi_xO_{2x+1}.yH_2O$, where M represents sodium or hydrogen, x is a number from 1.9 to 22, preferably from 1.9 to 4, with 2, 3, or 4 being particularly preferred values for x, and y represents a number from 0 to 33, preferably from 0 to 20. It is also possible to use amorphous sodium silicates with a modulus $Na_2O:SiO_2$ of 1:2 to 1:3.3, preferably of 1:2 to 1:2.8 and in particular of 1:2 to 1:2.6, which are preferably delayed in dissolution and have secondary washing properties.

In addition to the aforementioned builders, the cleaning agents according to the invention can also contain alkali metal hydroxides. These alkali carriers are preferably used in the cleaning agents and in particular in the at least one gel phase only in small quantities, preferably in quantities below 10 wt. %, preferably below 6 wt. %, more preferably below 5 wt. %, particularly preferably between 0.1 and 5 wt. %, and in particular between 0.5 and 5 wt. %, in each case based on the total weight of the cleaning agent. Alternative cleaning agents according to the invention are free of alkali metal hydroxides.

As an additional component, cleaning agents according to the invention preferably contain enzyme(s) in the at least one solid and/or the at least one gel phase. These include, in particular, proteases, amylases, lipases, hemicellulases, cellulases, perhydrolases, or oxidoreductases, as well as preferably mixtures thereof. Said enzymes are in principle of natural origin; proceeding from the natural molecules, improved variants for use in cleaning agents are available which are preferably used accordingly. Cleaning agents according to the invention preferably contain enzymes in total quantities of from $1\times10^{-6}$ wt. % to 5 wt. % based on active protein. The protein concentration can be determined with the aid of known methods, for example the BCA method or the Biuret method.

Among the proteases, the subtilisin-type proteases are preferred. Examples of these are the subtilisins BPN' and Carlsberg, as well as the further-developed forms thereof, protease PB92, subtilisins 147 and 309, the alkaline protease from *Bacillus lentus*, subtilisin DY, and the enzymes thermitase, proteinase K and proteases TW3 and TW7, which belong to the subtilases but no longer to the subtilisins in the narrower sense.

Examples of amylases that can be used according to the invention are α-amylases from *Bacillus licheniformis*, from *B. amyloliquefaciens*, from *B. stearothermophilus*, from *Aspergillus niger*, and *A. oryzae*, as well as the further developments of the above-mentioned amylases that have been improved for use in cleaning agents. Others that are particularly noteworthy for this purpose are the α-amylases from *Bacillus* sp. A 7-7 (DSM 12368) and cyclodextrin glucanotransferase (CGTase) from *B. agaradherens* (DSM 9948).

Furthermore, lipases or cutinases can be used according to the invention, in particular due to their triglyceride-cleaving activities, but also in order to produce peracids in situ from suitable precursors. These include, for example, the lipases that could originally be obtained from *Humicola lanuginosa*

(*Thermomyces lanuginosus*) and those that have been further developed, particularly those with the amino acid exchange in positions D96LT213R and/or N233R, particularly preferably all of the exchanges D96L, T213R, and N233R.

Moreover, enzymes can be used which can be grouped together under the term "hemicellulases." These include, for example, mannanases, xanthan lyases, pectin lyases (=pectinases), pectinesterases, pectate lyases, xyloglucanases (=xylases), pullulanases, and β-glucanases.

In order to increase the bleaching effect, oxidoreductases such as oxidases, oxygenases, catalases, peroxidases such as halo-, chloro-, bromo-, lignin, glucose, or manganese peroxidases, dioxygenases or laccases (phenoloxidases, polyphenoloxidases) can be used according to the invention. Advantageously, organic, particularly preferably aromatic compounds that interact with the enzymes are additionally added in order to potentiate the activity of the relevant oxidoreductases (enhancers) or, in the event of greatly differing redox potentials, to ensure the flow of electrons between the oxidizing enzymes and the contaminants (mediators). A protein and/or enzyme can be protected, especially during storage, against damage such as inactivation, denaturing, or decomposition caused for example by physical influences, oxidation or proteolytic cleavage. When the proteins and/or enzymes are obtained microbially, it is particularly preferable for proteolysis to be inhibited, particularly if the agents also contain proteases. Cleaning agents may contain stabilizers for this purpose; the provision of such agents constitutes a preferred embodiment of the present invention.

Cleaning-active proteases and amylases are generally not made available in the form of the pure protein, but rather in the form of stabilized, storable and transportable preparations. These ready-made preparations include, for example, the solid preparations obtained through granulation, extrusion, or lyophilization or, particularly in the case of liquid or gel agents, solutions of the enzymes, advantageously maximally concentrated, low-water, and/or supplemented with stabilizers or other auxiliaries.

Alternatively the enzymes can also be encapsulated for the at least one solid and/or the at least one gel phase, for example by spray-drying or extrusion of the enzyme solution together with a preferably natural polymer or in the form of capsules, for example those in which the enzymes are enclosed in a set gel, or in those of the core-shell type in which an enzyme-containing core is coated with a water-, air-, and/or chemical-impermeable protective layer. In the case of overlaid layers, other active substances, such as stabilizers, emulsifiers, pigments, bleaching agents, or dyes, can be additionally applied. Such capsules are applied using inherently known methods, for example by shaking or roll granulation or in fluidized bed processes. Such granular materials are advantageously low in dust, for example due to the application of polymeric film-formers, and stable in storage due to the coating.

Moreover, it is possible to formulate two or more enzymes together, so that a single granule exhibits a plurality of enzyme activities.

As is clear from the preceding remarks, the enzyme protein forms only a fraction of the total weight of conventional enzyme preparations. Protease and amylase preparations used according to the invention contain between 1 and 40 wt. %, preferably between 2 and 30 wt. %, particularly preferably between 3 and 25 wt. % of the enzyme protein. In particular, those cleaning agents are preferred which contain, based on their total weight, 0.1 to 12 wt. %, preferably 0.2 to 10 wt. %, and in particular 0.5 to 8 wt. % of the respective enzyme preparations.

According to another preferred embodiment, the at least one gel phase of the cleaning agent, in particular dishwashing detergent, preferably machine dishwashing detergent, contains at least one water-soluble zinc salt, preferably zinc chloride, zinc sulfate and/or zinc acetate, particularly preferably zinc acetate, for example zinc acetate anhydrate, preferably in a quantity of from 0.05 to 3 wt. %, in particular of from 0.1 to 2.4 wt. %, particularly preferably of from 0.2 to 1.0 wt. %, based on the total weight of the gel phase.

For a good incorporation ability of the zinc salts, in particular of zinc sulfate and/or zinc acetate, in particular of zinc acetate (e.g. in the water-free form of the salt) in low-water gel phases having carboxylate and/or sulfonic acid group-containing polymers, it is particularly preferred for the quantity of zinc salt in the water-free gel phase to be selected to be from 0.2 to 1.0 wt. %, for example 0.5 wt. %.

Besides the components cited above, the at least one solid and/or the at least one gel phase of the cleaning agent according to the invention can contain additional ingredients. These include, for example, anionic, cationic and/or amphoteric surfactants, bleaching agents, bleach activators, bleaching catalysts, other solvents, thickeners, sequestering agents, electrolytes, corrosion inhibitors, in particular silver protecting agents, glass corrosion inhibitors, suds suppressors, dyes, fragrances (in particular in the at least one solid phase), additives for improving the flow and drying behavior, for adjusting the viscosity, for stabilization, UV stabilizers, preservatives, antimicrobial active substances (disinfectants), pH adjusting agents in quantities of usually not more than 5 wt. %.

Agents according to the invention preferably contain at least one alkanolamine as an additional solvent. The alkanolamine is preferably selected from the group consisting of mono-, di-, triethanol- and propanolamine and mixtures thereof. The alkanolamine is preferably contained in agents according to the invention in a quantity of from 0.5 to 10 wt. %, in particular in a quantity of from 1 to 6 wt. %. In preferred cleaning agents, the at least one gel phase is substantially free of alkanolamine, i.e. the at least one gel phase contains less than 1 wt. %, in particular less than 0.5 wt. %, preferably less than 0.1 wt. %, particularly preferably less than 0.05 wt. %, of alkanolamine and the alkanolamine is only contained in the at least one solid phase.

In addition to the above-mentioned zinc salts, polyethyleneimines such as those which are available under the name Lupasol® (BASF) are preferably used as glass corrosion inhibitors in a quantity of from 0 to 5 wt. %, in particular from 0.01 to 2 wt. %.

Polymers that are suitable as additives are in particular maleic acid acrylic acid copolymer Na salt (for example, Sokalan® CP 5 by BASF, Ludwigshafen (Germany)), modified polyacrylic acid Na salt (for example, Sokalan® CP 10 by BASF, Ludwigshafen (Germany)), modified polycarboxylate Na salt (for example, Sokalan® HP 25 by BASF, Ludwigshafen (Germany)), polyalkylene oxide, modified heptamethyltrisiloxane (for example, Silwet® L-77 by BASF, Ludwigshafen (Germany)), polyalkylene oxide, modified heptamethyltrisiloxane (for example, Silwet® L-7608 by BASF, Ludwigshafen (Germany)), as well as polyethersiloxane (copolymers of polymethyl siloxanes with ethylene oxide/propylene oxide segments (polyether blocks)), preferably water-soluble, linear polyether siloxanes with terminal polyether blocks, such as Tegopren® 5840, Tegopren® 5843, Tegopren® 5847, Tegopren® 5851, Tegopren® 5863, or Tegopren® 5878 by Evonik, Essen (Germany). Builder substances suitable as additives are in particular polyaspartic acid Na salt, ethylene diamine triacetate cocoalkyl acetamide (for example Rewopol® CHT 12 from Evonik, Essen (Germany)), methylglycine tri-Na diacetic acid salt and acetophosphonic acid. In the case of Tegopren® 5843 and Tegopren® 5863, mixtures with surface-active or polymeric additives exhibit synergies. However, the use of Tegopren types 5843 and 5863 on hard surfaces made of glass, in particular glass dishes, is less preferred, since these silicone surfactants can adhere to glass. In a particular embodiment of the invention, the above-mentioned additives are omitted.

A preferred cleaning agent, in particular an automatic dishwashing detergent, preferably also comprises a bleaching agent, in particular an oxygen bleaching agent, as well as, optionally, a bleach activator and/or bleach catalyst. Insofar as they are present, they are contained exclusively in the at least one solid phase.

As a preferred bleaching agent, cleaning agents according to the invention contain an oxygen bleaching agent from the group of sodium percarbonate, sodium perborate tetrahydrate, and sodium perborate monohydrate. Further examples of bleaching agents which may be used are peroxypyrophosphates, citrate perhydrates as well as $H_2O_2$-yielding peracid salts or peracids, such as perbenzoates, peroxophthalates, diperazelaic acid, phthaloiminoperacid or diperdodecane diacid. Moreover, bleaching agents from the group of the organic bleaching agents can also be used. Typical organic bleaching agents are the diacyl peroxides, such as dibenzoyl peroxide. Other typical organic bleaching agents are the peroxy acids, with the alkylperoxy acids and the arylperoxy acids meriting special mention as examples. Due to its good bleaching performance, sodium percarbonate is particularly preferred. One particularly preferred oxygen bleaching agent is sodium percarbonate.

Compounds which, under perhydrolysis conditions, result in aliphatic peroxocarboxylic acids having preferably 1 to 10 C atoms, in particular 2 to 4 C atoms, and/or optionally substituted perbenzoic acid, may be used as bleach activators. Substances that carry the O- and/or N-acyl groups of the stated number of C atoms and/or optionally substituted benzoyl groups are suitable. Multiply acylated alkylene diamines are preferred, with tetraacetylethyl ethylenediamine (TAED) having proven to be particularly suitable.

The bleach catalysts are bleach-boosting transition metal salts or transition metal complexes such as, for example, Mn-, Fe-, Co-, Ru-, or Mo-salene complexes or -carbonyl complexes. Mn-, Fe-, Co-, Ru-, Mo-, Ti-, V-, and Cu-complexes with N-containing tripod ligands as well as Co-, Fe- Cu-, and Ru-ammine complexes can also be used as bleach catalysts. Complexes of manganese in oxidation stage II, III, IV, or IV are particularly preferably used which preferably contain one or more macrocyclic ligands with the donor functions N, NR, PR, O and/or S. Preferably, ligands are used which have nitrogen donor functions. It is particularly preferred to use bleach catalyst(s) in the agents according to the invention which contains or contain, as macromolecular ligands, 1,4,7-trimethyl-1,4,7-triazacyclononane (Me-TACN), 1,4,7-triazacyclononane (TACN), 1,5,9-trimethyl-1,5,9-triazacyclododecane (Me-TACD), 2-methyl-1-1,4,7-trimethyl-1,4,7-triazacyclononane (Me/Me-TACN), and/or 2-methyl-1,4,7-triazacyclononane (Me/TACN). Suitable manganese complexes are, for example, $[Mn^{III}{}_2(\mu\text{-}O)_1(\mu\text{-}OAc)_2(TACN)_2](ClO_4)_2$, $[Mn^{III}Mn^{IV}(\mu\text{-}O)_2(\mu\text{-}OAc)_1(TACN)_2](BPh_4)_2$, $[Mn^{IV}{}_4(\mu\text{-}O)_6(TACN)_4](ClO_4)_4$, $[Mn^{III}{}_2(\mu\text{-}O)_1(\mu\text{-}OAc)_2(Me\text{-}TACN)_2](ClO_4)_2$, $[Mn^{III}Mn^{IV}(\mu\text{-}O)_1(\mu\text{-}OAc)_2(Me\text{-}TACN)_2](ClO_4)_3$, $[Mn^{IV}{}_2(\mu\text{-}O)_3(Me\text{-}TACN)_2](PF_6)_2$ and $[Mn^{IV}{}_2(\mu\text{-}O)_3(Me/Me\text{-}TACN)_2](PF_6)_2$ (mit OAc═OC(O)$CH_3$).

The cleaning agent according to the invention preferably comprises at least one solid phase and at least one gel phase. The cleaning agent can thus have one, two, three, or more different solid phases; it may also have one, two, three or more different gel phases. The cleaning agent according to the invention preferably comprises a solid phase and a gel phase. The cleaning agent particularly preferably comprises two solid phases and a gel phase. It preferably comprises two solid phases and two gel phases. An embodiment is also preferred in which the cleaning agent comprises three solid phases and one or two gel phases.

In this case, the weight ratio of the entirety of the at least one solid phase to the entirety of the at least one gel phase is usually 40:1 to 2:1, in particular 20:1 to 4:1, preferably 14:1 to 6:1, for example 12:1 to 8:1. The total weight of all phases in a cleaning agent portion can be between 8 and 30 g, in particular 10 to 25 g, preferably 12 to 21 g, for example 13 to 17 g per cleaning agent portion. This weight ratio results in a good concentration of the respective ingredients of the solid or gel phase in a cleaning process.

According to the invention, the at least one solid phase and the at least one gel phase are adjacent to one another over all or part of their surfaces. It is preferred in this regard that the two phases be immediately adjacent.

If the at least one solid phase and the at least one gel phase are directly adjacent to each other over all or part of their surfaces, stability is important in addition to the shortest possible solidification time of the at least one gel phase. Here, stability means that components contained in the gel phase do not cross over into the at least one solid phase, but rather the at least one solid phase and the gel phase remain visually separate from one another even after a long period of storage and do not interact with each other, for example by the diffusion of liquid components from one phase to the other or the reaction of components of one phase with those in the other phase. Surprisingly, it has been found that this can be made possible by a gel phase that comprises, in addition to the at least one surfactant according to the invention, polyethylene glycols having an average molar mass of from 200 to 600 g/mol, glycerol, PVOH and at least one $C_3$ to $C_5$ alkanediol.

The present application also relates to a method for cleaning hard surfaces, in particular dishes, in which the surface is worked in an inherently known manner using a cleaning agent according to the invention. In particular, the surface is brought into contact with the cleaning agent according to the invention. The cleaning is performed in particular using a cleaning machine, preferably a dishwasher.

The present invention also relates to the use of a cleaning agent for cleaning hard surfaces, in particular dishes, in particular in dishwashers.

That which has been specifically disclosed above in relation to the cleaning agents also applies to the use and the method.

Insofar as it is stated in the present application that the cleaning agent according to the invention comprises something overall or in the at least one solid phase or in the at least one gel phase, this shall also be regarded as disclosing the fact that cleaning agents, or the relevant phase, can consist thereof. In the following practical example, the cleaning agent according to the invention is described in a non-limiting manner.

EMBODIMENTS

Cleaning agents according to the invention were prepared that comprise a solid phase and a gel phase. Different geometries were produced in the process. In addition, cleaning agents were prepared that comprise two solid phases and a gel phase. Cleaning agents were also prepared that comprise a solid phase and three, four and five gel phases (having the same or different composition). The following quantities refer to wt. % of active substance based on the total weight of the relevant phase (unless indicated otherwise).

TABLE 1

The solid granular mixtures of a solid composition, in particular powdered and free-flowing phases, had the following preferred composition:

| | wt. % |
|---|---|
| Citrate, Na salt | 15-20 |
| Phosphonate (e.g. HEDP) | 2.5-7.5 |
| MGDA, Na salt | 0-25 |
| Disilicate, Na salt | 5-35 |
| Soda | 10-25 |
| Silver protection (e.g. cysteine) | 0.0-1.0 |
| Percarbonate, Na salt | 10-15 |
| Bleach catalyst (preferably Mn-based) | 0.02-0.5 |
| Bleach activator (e.g. TAED) | 1-3 |
| Non-ionic surfactant(s), e.g., fatty alcohol alkoxy late, preferably 20-40 EO, optionally end-capped | 2.5-10 |
| Poly carboxy late | 4-10 |
| Cationic copolymer | 0-0.75 |
| Disintegrant - (e.g. crosslinked PVP) | 0-1.5 |
| Protease preparation (tq) | 1.5-5 |
| Amylase preparation (tq) | 0.5-3 |
| Perfume | 0.05-0.25 |
| Dye solution | 0.0-1 |
| Zn salt (e.g. acetate) | 0.1-0.3 |
| Sodium sulfate | 0.0-10 |
| Water | 0.0-1.5 |
| pH adjuster (e.g. citric acid) | 0-1.5 |
| Processing auxiliaries | 0-5 |

TABLE 2

The gel phases used had the following compositions (quantities in each case based on the total quantity of the gel phase):

| | wt. % |
|---|---|
| Water-soluble zinc salt (preferably zinc acetate) | 0.2-1.0 |
| Glycerol | 20-45 |
| Propanediol (preferably 1,3-propanediol) | 10-30 |
| Polymer comprising monomers having carboxylate and sulfonic acid-containing groups. preferably Acusol 588 or Acusol 590 | 5-20 |
| Nonionic surfactant(s) having a melting point of greater than 34° C. | 0.8-7.0, in particular 1.0-4.0 |
| Polyethylene glycol avg. molar mass 1,000-2,000 | 0-8 |
| Polyethylene glycol avg. molar mass 1,000-2,000 | 10-22 |
| Thickening agent (PVOH) | 10-22 |
| Processing auxiliaries | 0-5 |
| Dye solution | 0.0-0.5 |

The solid phases and gel phases could be combined as desired. The spatial configuration of the gel phase, which was liquid after mixing of the ingredients and dimensionally stable within a setting time of a maximum of 10 minutes, was predetermined by the spatial configuration of the solid phase and by molds that are commercially available or self-designed. A water-soluble wrapping in the form of an open pouch was produced by deep-drawing a PVOH-containing film. A liquid composition was poured into said open cavity and resulted in the gel phase after curing, then solid phases in the form of a free-flowing solid were poured into a pouch comprising polyvinyl alcohol, and the open pouch was then sealed by applying a second film and sealing by heat sealing.

TABLE 3

Compositions of the gel phase

| In wt. % | E1 | E2 | E3 | E4 | E5 | E6 | E7 | E8 |
|---|---|---|---|---|---|---|---|---|
| Water-free zinc acetate | 0.5 | 0.5 | 1 | 1 | 0 | 0 | 0.5 | 0.5 |
| Dehypon GRA M | 2.5 | 4 | 2.5 | 4 | 2.5 | 4 | 7 | 7 |
| Polymer comprising acrylic acid-containing and amidopropyl sulfonic acid-containing monomers | 10 | 10 | 10 | 10 | 10 | 10 | 10 | 10 |
| Glycerol | 25 | 25 | 25 | 25 | 25 | 25 | 24 | 25 |
| 1,3-propanediol | 30 | 30 | 30 | 30 | 30 | 30 | 28 | 29 |
| PEG 400 | 15 | 15 | 15 | 15 | 15 | 15 | 15 | 14 |
| PVOH (Mowiol 4-88) | 15 | 15 | 15 | 15 | 15 | 15 | 15 | 14 |
| Misc (inter alia, process auxiliaries, pH-adjusters, perfume, dye) | To make up to 100 | To make up to 100 | To make up to 100 | To make up to 100 | To make up to 100 | To make up to 100 | To make up to 100 | To make up to 100 |

Corresponding formulations have been prepared according to table 3.

It has been found that the presence of Dehypon GRA M has a positive influence on the sol-gel transition temperature. The sol-gel transition temperature means the temperature threshold at which a viscous flowing phase changes into a viscoelastic (gel) phase. With the addition of Dehypon GRA M, this transition temperature was higher than without Dehypon GRA M. The gels therefore needed less time for the formation of the gel phase and thus were already solid at higher temperatures.

After being poured into a corresponding cavity, these gel phases also demonstrated a lower egress, or no egress, of visible moisture (syneresis) compared with those gel formulations which did not contain a surfactant according to the invention. These gel phases were then packaged in single-use portions having a total weight of 18.5 g as described in table 2 together with solid phases according to table 1. It has been found in this case that the gel phases prepared in this way demonstrated particularly good processing properties with setting times of less than 1 min.

What is claimed is:

1. A cleaning agent comprising at least one low-water gel phase, which contains at least one non-ionic surfactant that has a melting point of greater than 30° C. in quantities from 0.1 to 15 wt. % based on the total weight of the gel phase, and characterized in that the gel phase contains at least one non-ionic surfactant of formula (II)

$$R1O[CH2CH2O]_y CH2CH(OH)R2,$$

in which R1 represents a linear or branched aliphatic hydrocarbon functional group having 4 to 22 carbon atoms, R2 represents a linear or branched hydrocarbon functional group having 2 to 26 carbon atoms, and y represents a value from 15 to 120, and characterized in that at least one organic solvent is contained in the gel phase.

2. The cleaning agent according to claim 1, wherein the at least one low-water gel phase further comprises at least one non-ionic surfactant of formula (I)

$$R1O[CH2CH(CH3)O]_x[CH2CH2O]_y[CH2CH(CH3)O]_zCH2CH(OH)R2$$

in which R1 represents a linear or branched aliphatic hydrocarbon functional group having 4 to 22 carbon atoms, R2 represents a linear or branched hydrocarbon functional group having 2 to 26 carbon atoms, x and z represents values from 0 to 40, and y represents a value of at least 15 in quantities from 0.1 to 15 wt. % based on the total weight of the gel phase.

3. The cleaning agent according to claim 1, characterized in that it contains, as a gelling agent, polyvinyl alcohol and/or derivatives thereof in a quantity from 4 to 40 wt. % in each case based on the total weight of the gel phase.

4. The cleaning agent according to claim 1, characterized in that the at least one organic solvent is present in the gel phase in quantities from 30 to 90 wt. % based on the total weight of the gel phase.

5. The cleaning agent according to claim 1, characterized in that the gel phase contains a polymer comprising a sulfonic acid group-containing monomer selected from acrylamidopropanesulfonic acids, methacrylamidomethylpropanesulfonic acids or acrylamidomethylpropanesulfonic acid.

6. The cleaning agent according to claim 1, characterized in that it contains, in the gel phase, at least one water-soluble zinc salt in a quantity from 0.05 to 3 wt. % based on the total weight of the gel phase.

7. The cleaning agent according to claim 1, characterized in that it additionally comprises at least one solid phase.

8. The cleaning agent according to claim 1, characterized in that it is a cleaning agent portion in a water-soluble wrapping having one or more chambers/compartments.

9. The cleaning agent according to claim 7, characterized in that the gel phase is contained in direct contact with the at least one solid phase.

10. The cleaning agent according to claim 1, being a dishwashing detergent.

11. The cleaning agent according to claim 1, comprising at least one substantially water-free gel phase, which contains at least one non-ionic surfactant that has a melting point of 40 to 60° C.

12. The cleaning agent according to claim 2, characterized in that the gel phase contains at least one non-ionic surfactant of formula (I), wherein y represents a value of at least 15, in quantities from 0.5 to 10 wt. % based on the total weight of the gel phase.

13. The cleaning agent according to claim 1, characterized in that the gel phase contains at least one non-ionic surfactant of formula (II), wherein y represents a value from 20 to 100.

14. The cleaning agent according to claim 3, characterized in that it contains polyvinyl alcohol and/or derivatives thereof in a quantity from 6 to 30 wt. % in each case based on the total weight of the gel phase.

15. The cleaning agent according to claim 1, characterized in that the at least one organic solvent is selected from 1,2-propanediol, 1,3-propanediol, glycerol, 1,1,1-trimethylolpropane, triethylene glycol, dipropylene glycol, polyethylene glycols and/or mixtures thereof.

16. The cleaning agent according to claim 4, characterized in that the at least one organic solvent is present in the gel phase in quantities from 40 to 85 wt. % based on the total weight of the gel phase.

17. The cleaning agent according to claim 6, characterized in that it contains, in the gel phase, zinc chloride, zinc sulfate and/or zinc acetate, in a quantity from 0.1 to 2.4 wt. % based on the total weight of the gel phase.

18. The cleaning agent according to claim 9, characterized in that the gel phase is contained in a chamber with the at least one solid phase.

* * * * *